US008600717B2

(12) United States Patent
Rashid et al.

(10) Patent No.: US 8,600,717 B2
(45) Date of Patent: Dec. 3, 2013

(54) PRODUCTION OPTIMIZATION FOR OILFIELDS USING A MIXED-INTEGER NONLINEAR PROGRAMMING MODEL

(75) Inventors: Kashif Rashid, Middlesex (GB); Suleyman Demirel, Ann Arbor, MI (US); Benoit Couet, Belmont, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 650 days.

(21) Appl. No.: 12/774,247

(22) Filed: May 5, 2010

(65) Prior Publication Data

US 2011/0119037 A1 May 19, 2011

Related U.S. Application Data

(60) Provisional application No. 61/178,248, filed on May 14, 2009.

(51) Int. Cl.

| | |
|---|---|
| ***G06G 7/48*** | (2006.01) |
| ***G06F 7/60*** | (2006.01) |
| ***G06F 17/10*** | (2006.01) |
| ***G01V 1/00*** | (2006.01) |

(52) U.S. Cl.
USPC ..... 703/10; 703/2; 367/25

(58) Field of Classification Search
USPC ..... 703/2, 10; 367/25
See application file for complete search history.

(56) References Cited

U.S. PATENT DOCUMENTS

| | | | |
|---|---|---|---|
| 7,434,619 | B2 | 10/2008 | Rossi et al. |
| 7,516,056 | B2 | 4/2009 | Wallis et al. |
| 7,640,149 | B2 | 12/2009 | Rowan et al. |
| 7,684,967 | B2 | 3/2010 | Wallis et al. |
| 2006/0265204 | A1 | 11/2006 | Wallis et al. |
| 2007/0010979 | A1 | 1/2007 | Wallis et al. |
| 2008/0103743 | A1 | 5/2008 | Howell et al. |
| 2008/0133194 | A1 | 6/2008 | Klumpen et al. |
| 2008/0140369 | A1 * | 6/2008 | Rashid et al. ..... 703/10 |
| 2008/0154564 | A1 | 6/2008 | Rashid |
| 2008/0319726 | A1 | 12/2008 | Berge et al. |
| 2010/0094605 | A1 | 4/2010 | Hajibeygi et al. |

OTHER PUBLICATIONS

Gutierrez, F. et al., "An Integrated, Innovative Solution to Optimize Hydrocarbon Production Through the Use of a Workflow Oriented Approach", May 20-21, 2008, SPE Gulf Coast Section 2008 Digital Energy Conference and Exhibition, Society of Petroleum Engineers.*

(Continued)

*Primary Examiner* — David Silver
*Assistant Examiner* — Cedric D Johnson
(74) *Attorney, Agent, or Firm* — Lam Nguyen; Rodney Warfford

(57) ABSTRACT

A system performs production optimization for oilfields using a mixed-integer nonlinear programming (MINLP) model. The system uses an offline-online approach to model a network of interdependent wells in an online network simulator while modeling multiple interdependent variables that control performance as an offline MINLP problem. The offline model is based on production profiles established by assuming decoupled wells in the actual network of wells. In one example, an amount of lift-gas to inject and settings for subsurface chokes are optimized. An offline solver optimizes variables through the MINLP model. Offline results are used to prime the online network simulator. Iteration between the offline and online models results in a convergence, at which point values for the interdependent variables are communicated to the real-world oilfield to optimize hydrocarbon production.

20 Claims, 15 Drawing Sheets

(56) References Cited

OTHER PUBLICATIONS

Wang, Pengji, "Development and Applications of Production Optimization Techniques for Petroleum Fields", Mar. 2003, Department of Petroleum Engineering, Stanford University.*

Ortiz-Gomez, A. et al., "Mixed-Integer Multiperiod Model for Planning of Oilfield Production", 2002, Computers and Chemical Engineering 26, Elsevier Science Ltd.* van den Heever, Susara et al., "A Mixed-Integer Nonlinear Programming Approach to the Optimal Planning of Offshore Oilfield Infrastructures", Aug. 2, 2006, Carnegie Mellon University.*

Kosmidis, Vassileios D. et al., "A Mixed Integer Optimization Formulation for the Well Scheduling Problem on Petroleum Fields", Jan. 20, 2005, Computers and Chemical Engineering 29, Elsevier Ltd.*

Young, Chi-Ta et al., "Information-Guided Genetic Algorithm Approach to the Solution of MINLP Problems", Feb. 8, 2007, Ind. Eng. Chem. Res., 46, American Chemical Society.* van den Heever, et al.; "An iterative aggregation/disaggregation approach for the solution of a mixed-integer nonlinear oilfield infrastructure planning model"; Ind. Eng. Chem. Res.2000, 39, pp. 1955-1971.

* cited by examiner

PRODUCTION OF AN INSTANTANEOUS FLOWING (IF) WELL

PRODUCTION OF A NON-INSTANTANEOUS FLOWING (NIF) WELL

SMOOTH PRODUCTION CURVE "*IF*" FOR AN INSTANTANEOUS FLOWING WELL

SMOOTH PRODUCTION CURVE "*NIF*" FOR A NON-INSTANTANEOUS FLOWING WELL

NON-SMOOTH PRODUCTION CURVE "*KNIF*" FOR A NON-INSTANTANEOUS FLOWING WELL

NON-SMOOTH PRODUCTION CURVE "*KIF*" FOR AN INSTANTANEOUS FLOWING WELL

PRODUCTION OPTIMIZATION FOR OILFIELDS USING A MIXED-INTEGER NONLINEAR PROGRAMMING MODEL

CROSS-REFERENCE TO RELATED APPLICATIONS

This patent application claims priority to U.S. Provisional Patent Application No. 61/178,248 filed May 14, 2009, which is incorporated herein by reference in its entirety.

BACKGROUND

As a producing oil field matures, the declining reservoir pressures from continued hydrocarbon extraction make oil production from existing and new wells harder. To alleviate this problem in part, natural gas is often injected at high pressure from the casing into the open wellbore of an oil well's string of tubes. This method of artificial lift is known as "gas-lift." As it is relatively inexpensive, easy to implement, and applicable over a broad range of conditions, it is a favored method of lift in many operating fields. Some or all of the gas produced by a field can be used as the source of lift-gas.

When natural gas is injected at high pressure into the wellbore near the bottom of the well, it mixes with the produced fluids from the reservoir, reducing the density of the fluid column and effectively lowering the bottom-hole pressure. The increased pressure differential induced across the sandface (the connection point between the reservoir and the well) allows more fluid to flow to the surface. However, too much lift-gas increases the frictional pressure drop and reduces the fluid production. Hence, although each well has a desirable lift-gas quantity, when the entire gathering network is considered, an optimal distribution must be made to account for the backpressure effects imposed by interconnected wells. This gives rise to a nonlinear gas-lift optimization problem. Even more broadly, the production also depends on the activation state of wells and the control of subsurface chokes that control flow, among other network elements.

To optimize production, a model of the oilfield must simultaneously optimize values for these different types of control variables. For large-scale network problems, this can be a difficult task when using conventional methods.

SUMMARY

A system performs production optimization for oilfields using a mixed-integer nonlinear programming (MINLP) model. The system uses an offline-online approach to model a network of interdependent wells in an online network simulator while modeling multiple interdependent variables that control performance as an offline MINLP problem. The offline model is based on production profiles established by assuming decoupled wells in the actual network of wells. In one example, optimizing production depends on optimizing an amount of lift-gas to inject while simultaneously optimizing flow settings on one or more subsurface chokes. The MINLP solver is used to solve the offline problem formulated without well interaction (as the wells are effectively assumed decoupled in the network model). Offline results are used as input to prime the online network simulation model. Iteration between the offline model and the online model results in a convergence, at which point values for the interdependent variables are communicated to the real-world oilfield to optimize oil production. Priming the online model with results from the offline model, and then iterating between the online and offline models drastically reduces computational load over conventional techniques. Additional techniques of annealing initial data starting points, smoothing pressure differences, and adaptively scaling constraint values further reduce computational intensity.

This summary section is not intended to give a full description of production optimization for oilfields using a mixed-integer nonlinear programming model, or to provide a list of features and elements. A detailed description of example embodiments follows.

DETAILED DESCRIPTION

Overview

Figure 1:
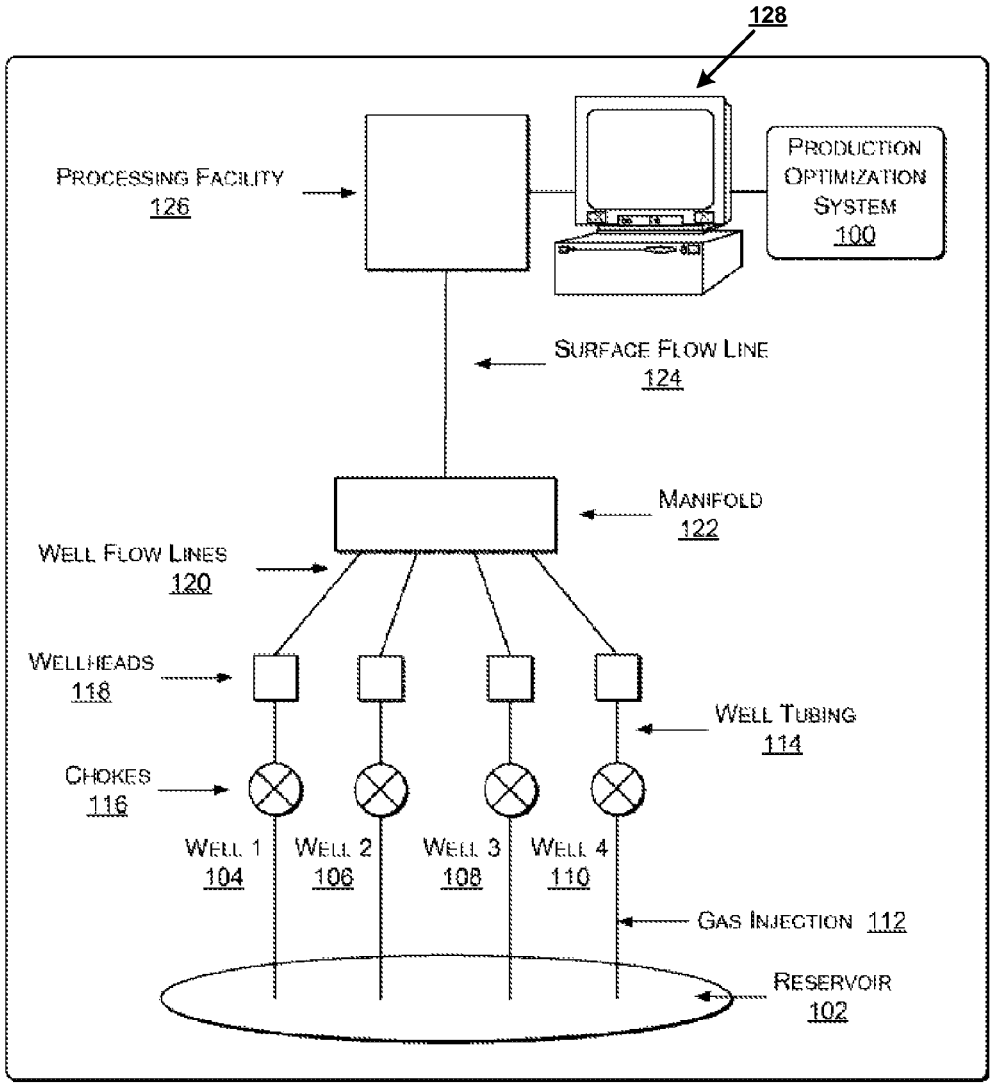
FIG. 1 is a diagram of an example network of interdependent oil wells with gas-lift capability and subsurface chokes, including an example production optimization system.

This disclosure describes production optimization for oilfields using a mixed-integer nonlinear programming model. This allows large-scale production optimization of hydrocarbons produced from a surface network in the presence of multiple operating constraints at branch, sink and mid-network level. The objective is to maximize hydrocarbon production or the revenue stream at the sink of a gathering network by suitably setting the control variables in the model. As the model can comprise wells with continuous gas-lift injection, block valves (discrete), integer or continuous sub-surface chokes, or some combination of these, this diversity in the multiple interdependent control variables leads to a mixed-integer nonlinear programming (MINLP) problem (for which there is limited conventional treatment due to the complexity of non-smoothness and non-differentiability of the underlying network simulation model). In addition, computational effort is compounded by the fact that each function evaluation (a network simulation run) can be costly and no derivative information is available. The MINLP approach described herein provides a modeling framework that can handle a number of production scenarios efficiently, while further reducing the number of function evaluations used by previous simulation techniques.

In one implementation, a methodology, comprising applying the "A Mathematical Programming Language" (AMPL) modeling language in conjunction with a suitable MINLP-based solver, is devised to handle a wide range of production optimization problems in a computationally efficient manner. A MINLP formulation presented herein is general enough to optimize a number of production scenarios, including wells with dual gas-lift and choke control. The methodology enables near optimal solutions to be obtained, while significantly reducing the number of simulation calls.

In one implementation, the limitations of existing gas-lift optimization (GLO) solvers are addressed with an extended formulation that includes both continuous gas-lift injection and includes the control of discrete, integer or continuous subsurface chokes. Traditional nonlinear programming (NLP) methods are unable to handle such highly nonlinear mixed-integer problems. Hence, the new formulation and utilization of a suitable MINLP solver enables a greater spectrum of production optimization problems to be solved. For example, the capability to activate and deactivate wells using chokes allows well activation, well-rate management and dual control problems to be treated in an efficient manner.

Improvements are presented to the original gas-lift optimization (GLO) offline-online procedure to further reduce the overall number of simulator calls needed to obtain a solution, including the use of average pressures, constraint scaling and an iterative metric-based well deactivation procedure. Also, as computational power has increased in general, novel methodologies for efficiently solving MINLPs are available for production optimization purposes.

Example System

FIG. 1 shows an example hydrocarbon production layout, including an example production optimization system 100. The layout includes a hydrocarbon reservoir 102, such as an oilfield, with multiple wells drilled down to the reservoir 102, such as well "1" 104, well "2" 106, well "3" 108, and well "4" 110. Well "4" 110 has a connection for gas injection 112, which liberates lift-gas into the wellbore to "pump" liquid to the surface through the buoyancy effects of the gas. The gas can be natural gas obtained from the same hydrocarbon reservoir 102. The well tubing 114 may have chokes 116 connected along the tubing string. A subsurface choke 116 is a downhole device, a "valve," used to control fluid flow under downhole conditions. Downhole chokes 116 are generally removable with slickline intervention and are located in a landing nipple in the tubing string. Landing nipples are included in most completions at predetermined intervals to enable the installation of flow-control devices, such as plugs and the chokes 116.

A wellhead 118 caps each well 104, and well flow lines 120 may connect the wells together through a manifold 122. The wells connected to one or more manifolds 122 make up a network of interconnected wells, since the manifold 122 allows a flow rate or wellhead pressure in one well 104 to affect the other connected wells 106, 108, 110. Variables at play in one or more of the interdependent wells are likewise interdependent, e.g., since a rate (or an amount) of gas injection 112 and a choke setting in one or more of the wells can affect the entire system. The net production of the network of interdependent wells may be evident at a surface flow line 124 that transfers the total output of the "gathering network." A processing facility 126 may separate and process hydrocarbons and other components (e.g., natural gas; water). The processing facility 126 has computer control via a computing system 128 and in FIG. 1, executes the example production optimization system 100 described herein.

Figure 2:
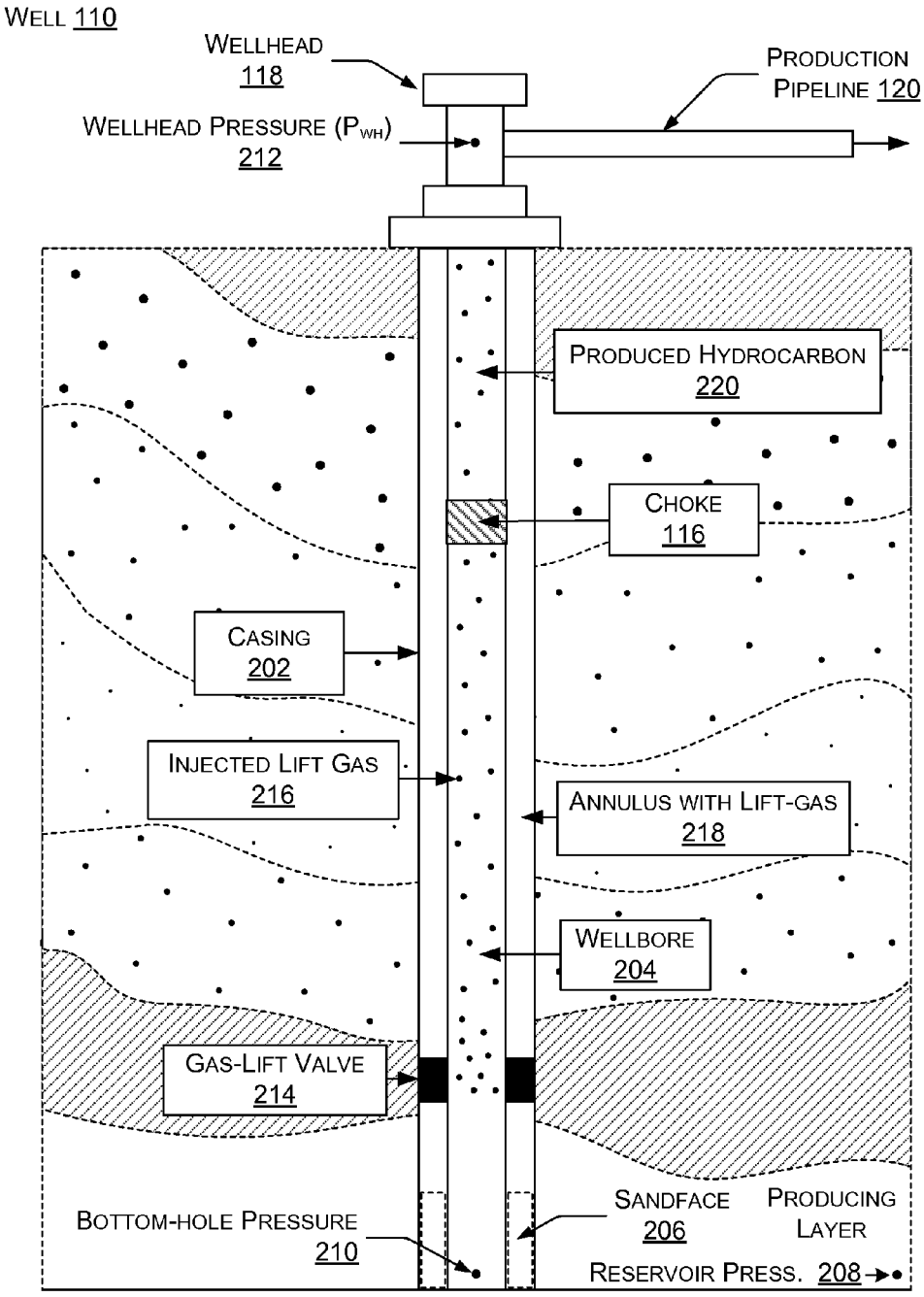
FIG. 2 is a diagram of an example single oil well with gas-lift capability and a subsurface choke.

FIG. 2 shows an example individual well 110 with gas-lift capability and a subsurface choke. A well casing 202 has an open lumen, the wellbore 204, that penetrates the earth or seabed to the reservoir 102, and ends in a sandface 206, which is the physical interface between the geo-formation and the wellbore 204. The diameter of the wellbore 204 at the sandface 206 is one of the dimensions used in production models to assess potential productivity. The reservoir pressure 208 at the producing layer gives rise to a bottom-hole pressure 210, and in an instantaneously flowing well, gives rise to a wellhead pressure 212. To decrease the wellhead pressure 212 (i.e., lift the oil or other hydrocarbon mixture to the surface) a gas-lift valve 214 introduces natural gas at high pressure, i.e., an injected lift-gas 216, into the hydrocarbon mixture, i.e., flows gas through the gas-lift valve 214 into the wellbore containing production fluid in order to reduce the density of the fluid column and help raise it to the surface.

The injected lift-gas 216 may reach the gas-lift valve 214 via an open annulus 218 between the interior surface and the exterior surface of the casing 202. Produced hydrocarbon 220, mixed with the lift-gas, rises to the wellhead 118, where it is transferred to a manifold 122 or to a processing facility 126 via a well flow line 120 or production pipeline.

Figure 3:
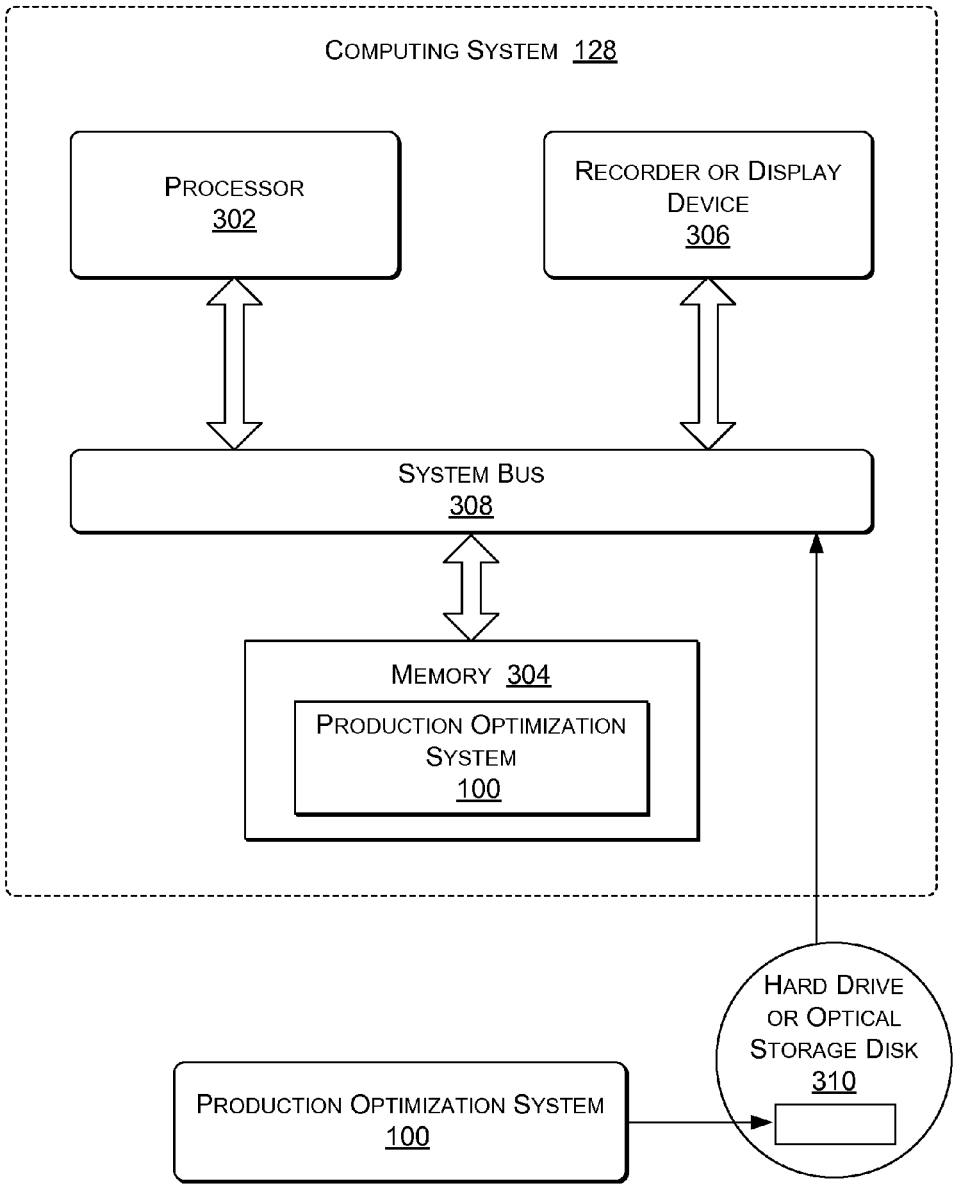
FIG. 3 is a block diagram of a computing device for running software elements of the example production optimization system of FIG. 1.

FIG. 3 shows an example computing system 128 that can execute the example production optimization system 100. The computing system 128 has components, such as a processor 302, memory 304, and recorder or display 306 connected to a common system bus 308. The production optimization system 100 may exist as hardware devices, e.g., as one or more application-specific integrated circuits (ASIC chips), or as hardware and software. Software components may be executed from memory 304 and stored as computer-executable instructions on a computer-readable storage medium 310, such as a hard drive, flash drive, CD-ROM, DVD, etc., accessible to the system bus 308.

Figure 4:
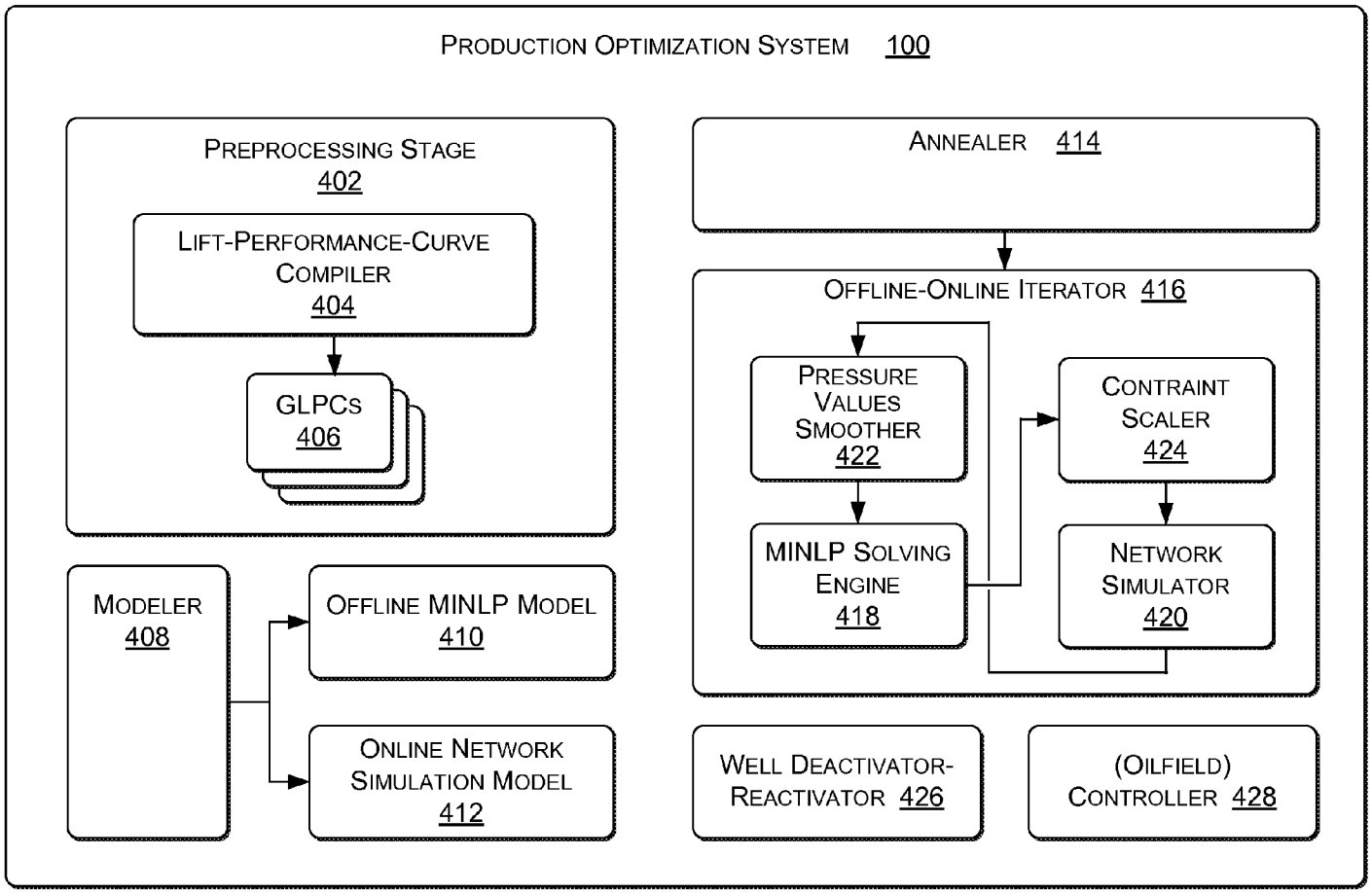
FIG. 4 is a block diagram of the example production optimization system of FIG. 1, in greater detail.

FIG. 4 shows the example production optimization system 100 of FIG. 1 and FIG. 3, in greater detail. The illustrated implementation in FIG. 4 is meant to provide only one example system. Many other arrangements of the illustrated components, or similar components, are possible within the scope of the subject matter being described. Such a system may consist of a combination of hardware and software. Each component shown in FIG. 4 can communicate with each of the other components, unless explicitly noted.

The example production optimization system 100 includes a preprocessor 402, which includes a lift-performance-curve compiler 404, to obtain gas-lift performance curves (GLPCs) 406 for each gas-lift well. The pre-processing step may also include establishing production profiles as a function of choke setting for each well.

A modeler 408 creates an offline mixed-integer nonlinear programming (MINLP) model 410 and determines parameters for an online simulation model 412. The production optimization system 100 may generate user interfaces as needed to gather input and selections from a human user in the modeling, the preprocessing stage, and so forth.

An optional annealer 414 may generate initial starting values for variables in the offline MINLP model 410 and/or the online network model 412 to accelerate computation and optimization of control variables for maximizing hydrocarbon production. An offline-online iterator 416 manages alternate execution of an offline MINLP solving engine 418 for processing the offline MINLP model 410 on one hand, and an online network simulator 420 for executing the online network simulation model 412 on the other hand. The MINLP solving engine 418 may include a known MINLP solver 606. During iteration, output from the MINLP solving engine 418 becomes input for the network simulator 420, and vice versa: output from the network simulator 420 becomes input for the MINLP solving engine 418 in subsequent iterations.

Intervening between the output of the online network simulator 420 and the input of the offline MINLP solving engine 418 is an optional pressure values smoother 422, which facilitates quick convergence during the iteration process by equalizing artifactual pressure differences arising during computation—pressure differences that can usually be eliminated because in reality the interdependent wells are connected to the same manifold 122, so should have the same wellhead pressure 212.

Intervening between the output of the offline MINLP solving engine 418 and the input of the online network simulator 420 is an optional constraint scaler 424 that adapts constraint values between the problem solving algorithms of the MINLP solving engine 418 and the problem solving algorithms of the network simulator 420, thereby reducing computational load that can arise merely over unadapted constraint values that are disjoint between the two models.

An optional well deactivator-reactivator 426 handles the special case in which an optimal setting for the aperature of a choke 116 is zero, thereby completely shutting down flow from the associated well in favor of optimizing productivity from the rest of the network of interconnected wells, as a single organic system.

A controller 428 receives optimized values of the control variables being determined by the offline-online iterator 416 (and by the larger production optimization system 100) and transfers these optimized values to a real-world control center of an actual oilfield or hydrocarbon reservoir 102, to maximize real-world hydrocarbon productivity. The control center applies the optimized control values to network devices, for example, to the gas injection delivery system and gas-lift valves 216 and to relevant chokes 116 or other valves.

Operation of the Example System

Components of a production optimization system 100 have just been described. The functionality of the system and components will now be described.

1. Basic Gas-Lift Optimization in General

A methodology for gas-lift optimization (GLO) is presented in U.S. patent application Ser. No. 11/711,373 to Rashid, entitled, "Method for Optimal Lift-gas Allocation" (the "Rashid reference"), which is incorporated herein by reference in its entirety. The Rashid reference describes an iterative offline-online procedure in which an online network model is replaced by an offline curve-based approximation by enforcing the notion of well separability when establishing production profiles. Results from the offline part of the procedure are input into the online network model, which greatly facilitates speed of computation by reducing the number of function calls that the network simulator must perform. Results from the online part of the procedure are fed back to the offline procedure, and the offline-online procedure iterates until wellhead pressure values converge. That is, the offline-online procedure defines an approximate optimization problem (the offline problem) based on production profiles derived when the wells are treated as decoupled in the actual network model. The procedure then plugs the optimal solution into the online problem in the network simulator, and in turn updates the offline problem based on the wellhead pressures obtained from the most recent simulation run (the online problem), repeating the procedure until convergence. The method is significantly more efficient compared to conventional approaches, achieving comparable results in only a fraction of the number of simulator evaluations.

In the Rashid reference, an optimal lift-gas allocation is achieved using a Newton reduction method (NRM), which converts the original nonlinear constrained problem into one of a single variable with a strict equality. At the final solution, each well has the same sensitivity to an incremental gain in lift-gas.

A gas-lifted field is constrained by the amount of gas available for injection or additionally, the produced gas permissible due to separator constraints. Under these, and other operating constraints, it is necessary for engineers to optimally allocate the available lift-gas to maximize the field oil production, revenue, or indeed profit. In order to do so, it is common practice to model the physical system using a multiphase flow simulator with data collected at the well site. The ensuing model is used for optimization purposes, and if the model is an accurate representation of the physical system, the optimal configuration can be applied directly to the real system, either manually or automatically in a closed loop by the controller 428.

A gas-lift network model in a steady-state multiphase flow simulator typically includes a description of the gathering network, well configurations, the pressures or flow rates at boundary conditions, the composition of the produced fluid in each well, multiphase flow correlations employed, and the quantity of lift-gas injected into each well. The latter can be considered control variables, while the elements that precede can be deemed as constant network parameters, at least with respect to a gas-lift optimization scenario. For a network with multiple wells, the objective is to optimally allocate a fixed amount of gas, such that the oil production at the sink node is maximized.

The problem to be solved is a nonlinear constrained optimization problem in which each function evaluation requires a call to the network simulator. In the context of the present methodology, this is referred to as the online problem. As each function evaluation is a call to the underlying network simulator, these approaches can be time-consuming and computationally costly, especially if the number of variables is great, numerical derivatives are required, and the simulation is expensive to run, as is often the case. However, as the network model performs a rigorous pressure and flow rate balance, the benefit is that a steady-state solution is returned, in contrast to methods in which the interaction of interconnected wells is neglected.

Figure 5:
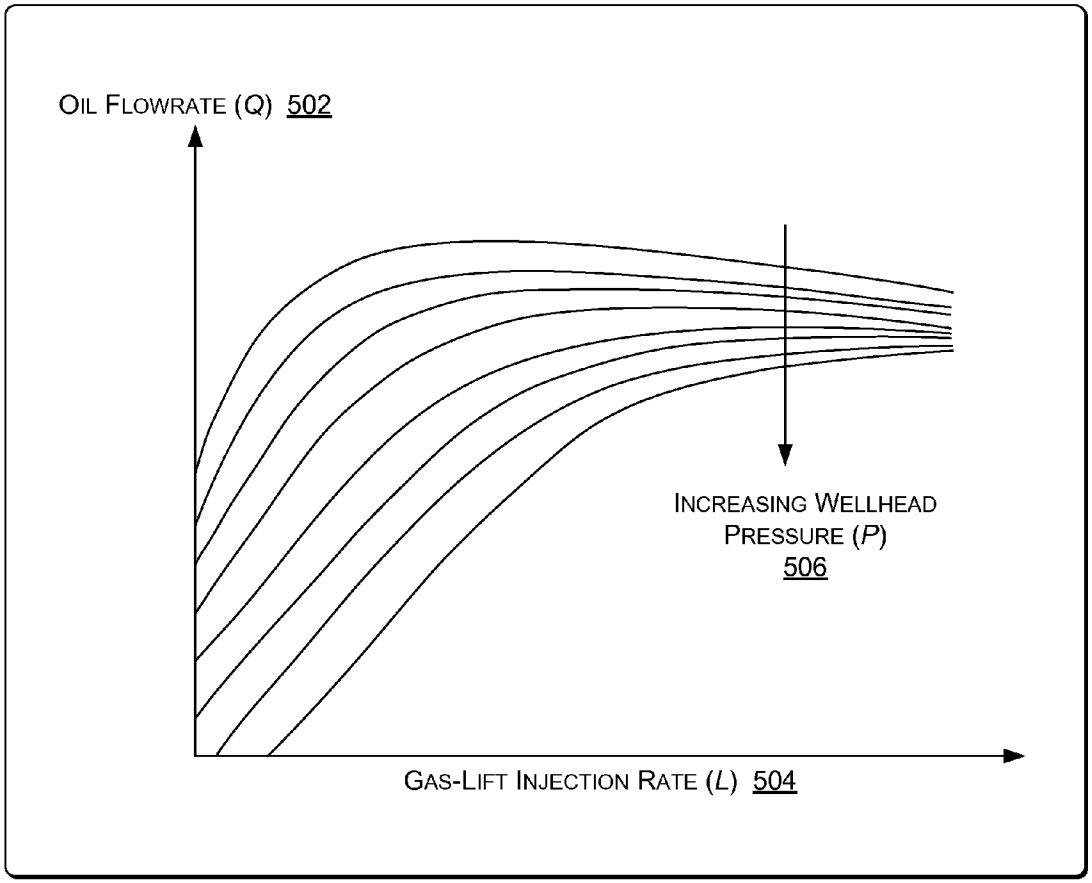
FIG. 5 is a diagram of a representative family of lift performance curves.

When the wells are considered as decoupled in the actual network model for purposes of establishing production profiles for given wellhead pressure conditions, then the problem can be defined by a separable program—the offline part of the procedure. Referring to FIG. 5, the offline model 410 uses production flow rate (502) versus gas-lift injection rate (504) profiles, the gas-lift performance curves (GLPCs) 406, defined for each well. The objective function used in the model is given as the sum of all well flow rates. FIG. 5 shows a representative family of lift performance curves for a well. The lift profiles for each well can be obtained from actual well step-rate tests conducted at the well site or from single well nodal analysis calculation. While the former is likely to be more accurate and representative of the actual behavior observed, the latter is more practical for fields with many wells and can also provide a family of curves that accommodate varying wellhead pressures 506.

2. Production Optimization Using a MINLP Model in an Offline-Online Methodology

Figure 6:
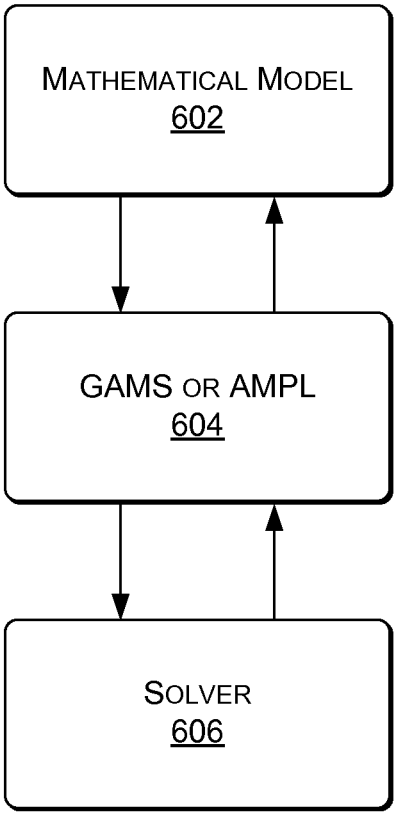
FIG. 6 is a block diagram of an example modeling framework.

Referring to FIG. 6, General Algebraic Modeling System (GAMS) and AMPL 604 are among the most widely used modeling languages 604 for optimization problems. Other modeling languages 604 include advanced interactive multi-dimensional modeling system (AIMMS), advanced process monitor (APMONITOR), mathematical programming system (MPS), OPTIMJ™ (commercially available from the Ateji Corporation) and the GNU Linear Programming Kit (GLPK). A modeling language 604 lets the user create a mathematical model 602 in a very intuitive way. For sufficiently straightforward models 602, the user does not need to be equipped with any prior knowledge of programming languages. For more complicated problems that require user intervention such as generating multiple starting points and solving the problem for each starting point, basic knowledge of programming languages, such as loops and "if statements," is very helpful. As shown in FIG. 6, a primary role of the modeling languages 604 is to interpret the model file 602 for a solver 606. Solvers 606 are specialized algorithms designed to solve a specific family of problems. There are various solvers 606 available, such as Complex NonLinear Solver (CPLEX®), which is specialized to solve linear and mixed-integer programs. Some solvers 606 can only be called within GAMS or AMPL, and others by both.

3. Optimization with MINLP Solvers

A number of MINLP solvers can be used to solve mixed-integer nonlinear problems. Among these solvers are Breach-And-Reduce Optimization Navigator (BARON), Basic Open-source Nonlinear Mixed Integer programming (BONMIN), FILMINT, FILTER, MINLP and Simple Branch-and-Bound (SBB). To gain insight into how these solvers perform, a simple gas-lift allocation problem was formulated and tested on the known 56-well case presented by Buitrago et al. (Buitrago, S., E. Rodriguez, D. Espin, "Global optimization techniques in gas allocation for continuous flow gas-lift systems," 1996: hereinafter, "the Buitrago reference").

3.1 Basic Model

Figure 7:
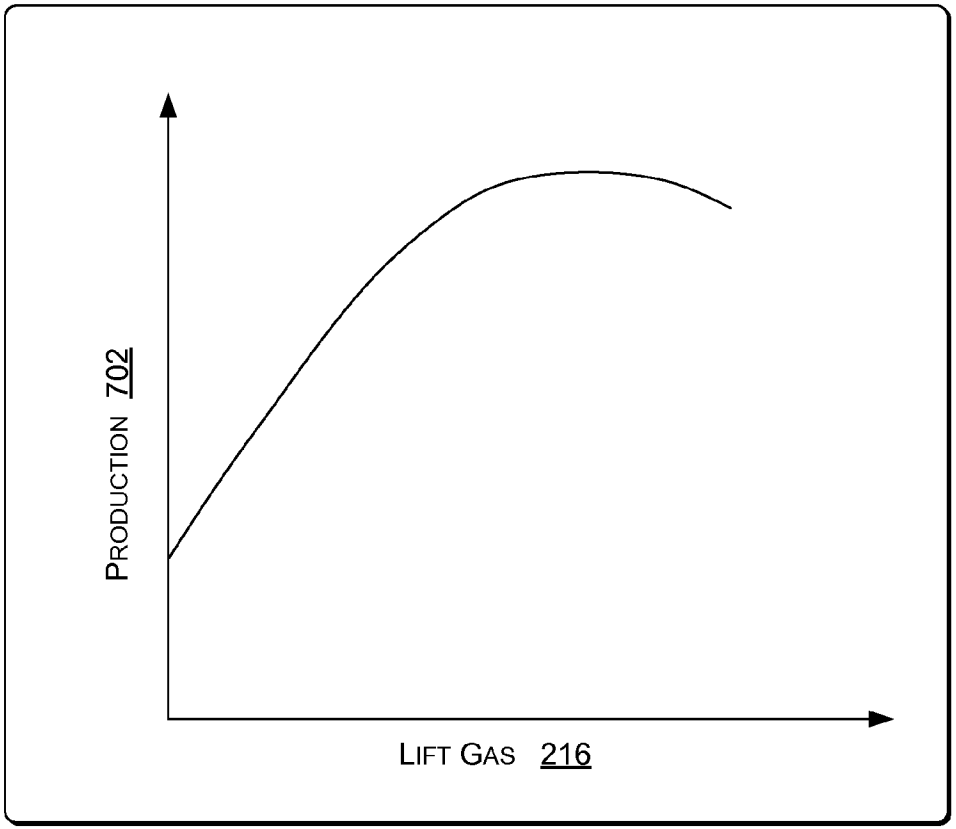
FIG. 7 is a diagram of example production of an instantaneous flowing (IF) well.
Figure 8:
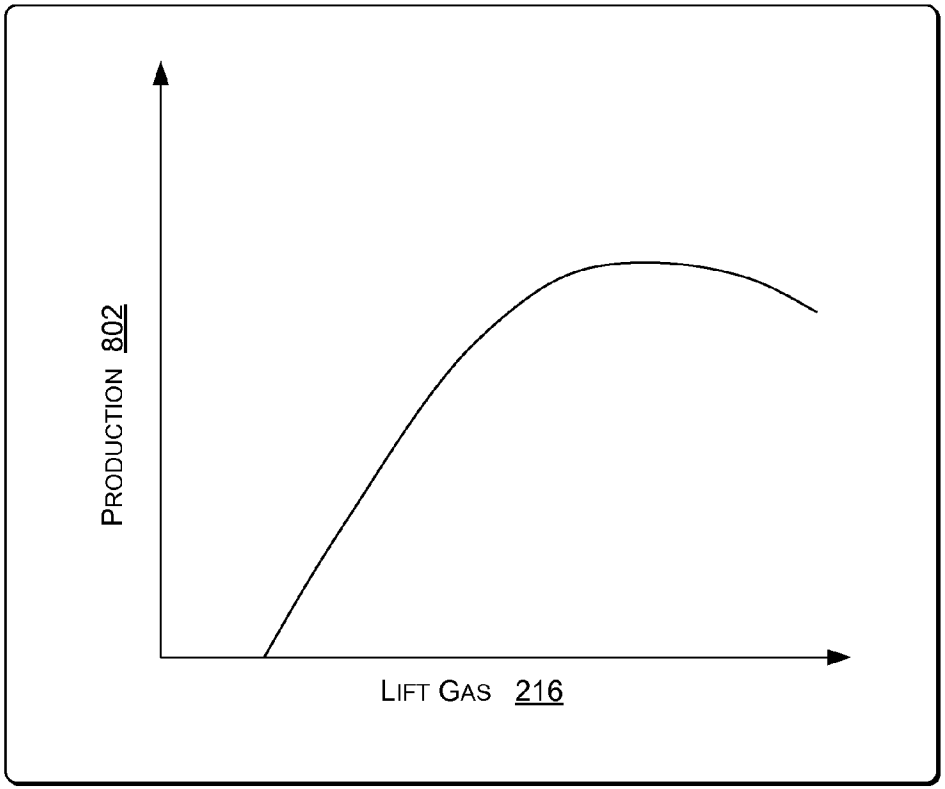
FIG. 8 is a diagram of example production of a non-instantaneous flowing (NIF) well.

The basic model considers optimal allocation of limited lift-gas 216 to several independent wells with known production profiles. The wells fall into two categories; instantaneous flowing (IF) wells with a production 702 versus lift-gas 216 function as shown in FIG. 7, or non-instantaneous flowing (NIF) wells with a production 802 versus lift-gas 216 function as shown in FIG. 8. In particular, in the basic model there are n non-instantaneous flowing wells, which have respective lower and upper bounds ($l_i$ and $u_i$) on the lift-gas injection rate. Well i does not produce if the injected gas 216 is lower than $l_i$. The injected lift-gas rate is denoted by $x_i$ and for $x_i \geq l_i$, the production of the well is described by a quadratic function: $g_i(x_i)=a_i x^2+b_i x_i+c_i$.

Let $q_i(x_i)$ denote the production function of well i. Then $q_i(x_i)$ is expressed as follows:

$$q_i(x_i) = \begin{cases} 0 & \text{if } x_i < l_i \\ g_i(x_i) & \text{if } x_i \geq l_i \end{cases} \tag{3}$$

As can be observed, $q_i(x_i)$ is not differentiable at $x_i=l_i$. This is undesirable because almost all solvers require that the objective function is twice continuously differentiable. To overcome this, a binary variable $y_i$ is defined, which takes a value "1" if the well i is open, and a value of "0" otherwise. As a result, $$g_i(x_i)=g_i(x_i)y_i \tag{4}$$

A number $n_0$ of instantaneous flowing wells with a production function $a_i^0(x_i^0)^2+b_i^0 x_i^0+c_i^0$ are also considered. (A null subscript or superscript refers to an instantaneous flowing well). The MINLP is formulated to represent the problem as follows:

$$\max \sum_{i=1}^{n_0} g_i^0(x_i^0) + \sum_{j=1}^{n} g_j(x_j)y_j \tag{5}$$

$$\text{s.t} \sum_{i=1}^{n_0} x_i^0 + \sum_{j=1}^{n} x_j \leq C \tag{6}$$

$$0 \leq x_i^0 \leq u_i^0 \quad i = 1, 2, \ldots, n_0 \tag{7}$$

$$l_j y_j \leq x_j \leq u_j y_j \quad j = 1, 2, \ldots, n \tag{8}$$

$$y_j \in \{0, 1\} \quad j = 1, 2, \ldots, n \tag{9}$$

Equation (6) represents the capacity constraint and Equations (7) and (8) specify lower and upper bounds on wells. The problem contains $n+n_0$ continuous variables and n binary variables. The number of constraints is $2n+2n_0+1$.

3.2 Testing Buitrago's 56-Well Case

The above formulation and the performance of various solvers 606 were tested using the 56-Well Case analyzed by the Buitrago reference. The problem is formulated in both AMPL and GAMS languages 604 and solved using MINLP solvers 606, e.g., as available on NEOS servers (http://www-neos.mcs.anl.gov). The GAMS input allows testing BARON and SBB and the AMPL input allows testing BONMIN, FILMINT, FILTER, and MINLP. Among these solvers 606, BONMIN is an open-source solver 606 available through COIN-OR (Computational Infrastructure for Operations Research-open source for the operations research community).

In Buitrago's 56-well case, the first 46 wells are IF wells and the remaining 10 wells are NIF wells. A fitted parabola is placed as each well's production function. The Buitrago reference does not impose explicit upper bounds on the wells. However, in the exemplary formulation used in the testing, an upper bound is imposed, where the production function is maximized, i.e., the derivative equals zero. By doing so, the size of the search region is reduced.

In the following, the solutions found by the solvers 606 of interest are presented. BARON finds the best solution among all the solvers 606 since it is a global MINLP solver 606. The performance of BARON was tested by uploading a GAMS model on NEOS servers.

Other solvers 606 (BONMIN, SBB, MINLP, FILTER, FILMINT) were not able to return a global solution. They provided a locally optimal solution. When no starting point is provided, these solvers 606 reach a suboptimal solution that is typically close to (e.g., within approximately 2.82% of) the optimally calculated solution.

In one run, all the binary variables were set to "1" initially, which indicates that all NIF wells are in an initially open state. With this starting point, BONMIN returned a solution with only two wells deactivated to optimize network performance. Thus, starting with all NIF wells actively operating does lead to a solution.

In one case, a random starting point was generated by initially activating or deactivating NIF wells with equal probabilities. In this case, best solution found by BONMIN was the one obtained with the random starting point. This suggests that the problem can be solved for a number of times with random starting points and the one with the highest objective function value can be used.

Next, algorithms are developed to use BONMIN as a global optimizer. BONMIN is a global optimizer for convex problems, however it acts

TABLE 3

Performance of the Solvers

| Solver | Starting Configuration | Objective Value (stb) | Active NIF Wells (index no.) | Optimality Gap | Time Elapsed |
|---|---|---|---|---|---|
| BARON | None | 23,382 | 48, 49, 56 | 0.00% | 2 min 26 sec |
| Bonmin | All NIF Wells Closed | 22,722 | None | 2.90% | <1 sec |
| Bonmin | All NIF Wells Open | 20,955 | 47, 48, 49, 52, 53, 54, 55, 56 | 11.58% | <2 sec |
| Bonmin | Randomized | 23,364 | 48, 53, 56 | 0.08% | <1 sec |

as a local optimizer for non-convex problems. As demonstrated above, the ability of the algorithm to find a good solution depends on the choice of the initial conditions. In particular, the solution is dependent on the choice of the binary variables in the gas-lift optimization problem. For any given initial binary vector, the algorithm converges to a locally optimal solution within less than a second for Buitrago's 56-well case, which indicates that BONMIN is very quick at solving nonlinear problems. However, the discrete nature of the problem leads the algorithm to end up with local optima. The algorithmic details of BONMIN can be found in Bonami et al. (2008).

A preferred embodiment uses BONMIN as it is open-source and can be enhanced through the algorithms developed below (with no modification in BONMIN source code). With the algorithms developed below, either the optimal solution is obtained, or near-optimal solutions with a tight optimality gap are obtained.

3.3 Global Optimization with Local Optimizers

This section shows development of algorithms to generate initial values for the binary variables and improve the quality of the solution the solver 606 returns. Buitrago's case has 10 binary variables, which implies 1024 potential initial values. A novel algorithm described herein enumerates all potential starting points and obtains a solution from the BONMIN solver 606. At each iteration, this new algorithm keeps track of the best objective value ever found. When the enumeration stage is complete, the algorithm returns the globally optimal solution.

Figure 9:
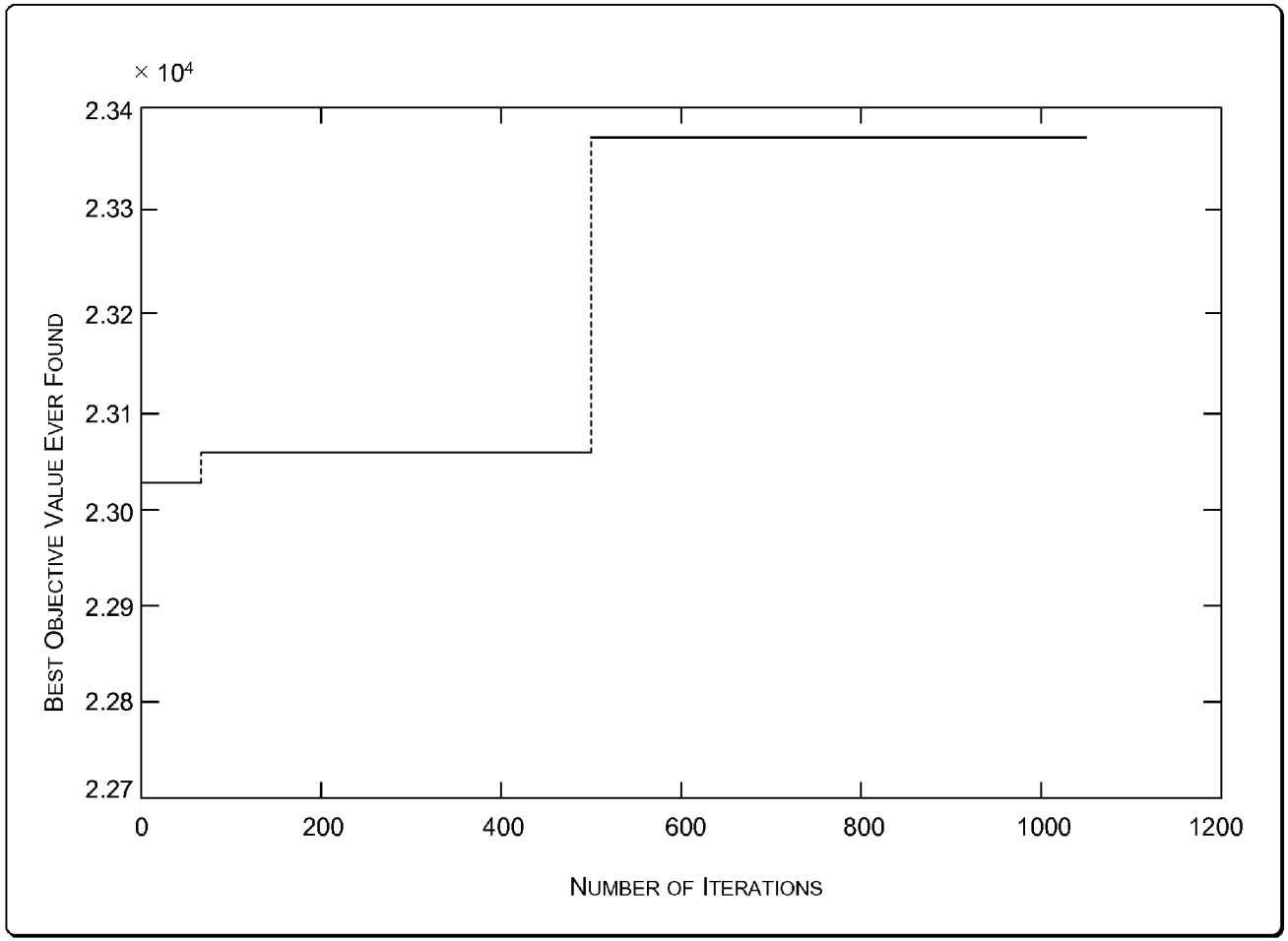
FIG. 9 is a diagram of current best objective values versus number of iterations, from an enumeration algorithm.

In one test instance, for the Buitrago's case, it required 527 seconds (8.8 mins) for a run to complete. The optimal solution was found at the 519th iteration. The best objective value ever found at each iteration is demonstrated in FIG. 9.

Enumerating all combinations of the binary variables may be very costly if the number of variables is high. To meet this challenge, a new, simulated annealing algorithm, suitable for use in the annealer 414, was developed to generate starting points sequentially in expectation of finding better objective function values. The annealing algorithm is adapted from Fubin, Q., and Rui, D., "Simulated Annealing for the 0/1 Multidimensional Knapsack Problem," 2008. Some notations are introduced and then the annealing algorithm is presented.

Notation:

| | |
|---|---|
| x | Vector of gas allocations |
| y | Vector of binary variables |
| z | Objective Function Value |
| $y^0$ | Basis of the Next Starting Point |
| $y^s$ | Starting Point to pass BONMIN |
| BONMIN($y^s$) | A function that returns BONMIN's resulting solution (x; y; z) given the starting point $y^s$ |

-continued

Notation:

| | |
|---|---|
| $T_0$ | Initial Temperature |
| $T_{min}$ | Minimum Temperature |
| $\alpha$ | Temperature Shrinking Factor |
| M | Number of Iterations at Each Temperature |

Simulated Annealing Type Algorithm:

```
Initialize:
    Set T0, Tmin, α and M.
    Temperature: T ← T0.
    Randomize y^s ∈ {0, 1}^n.
    (x,y,z) ←Bonmin (y^s).
    Basis of the Next Starting Point: y^0 ← y.
    Current Best: (x,*y*,z*) ← (x,y,z).
while T ≥ Tmin do
  for m = 1 to M do
    y^s ← y^0.
    Select an integer i from {1,2,...,n} randomly.
    y_i^s ← 1 − y_i^s.
    (x,y,z) ←Bonmin (y^s).
    if z > z* then
      Current Best: (x,*y*,z*) ← (x,y,z).
      Basis of the Next Starting Point: y^0 ← y.
    else
      Generate Rand=Uniform(0,1).
      if Rand < e^(−(z*−z)/T) then
        Basis of the Next Starting Point: y^0 ← y.
      end if
    end if
  end for
  Temperature: T ← αT
end while
```

Figure 10:
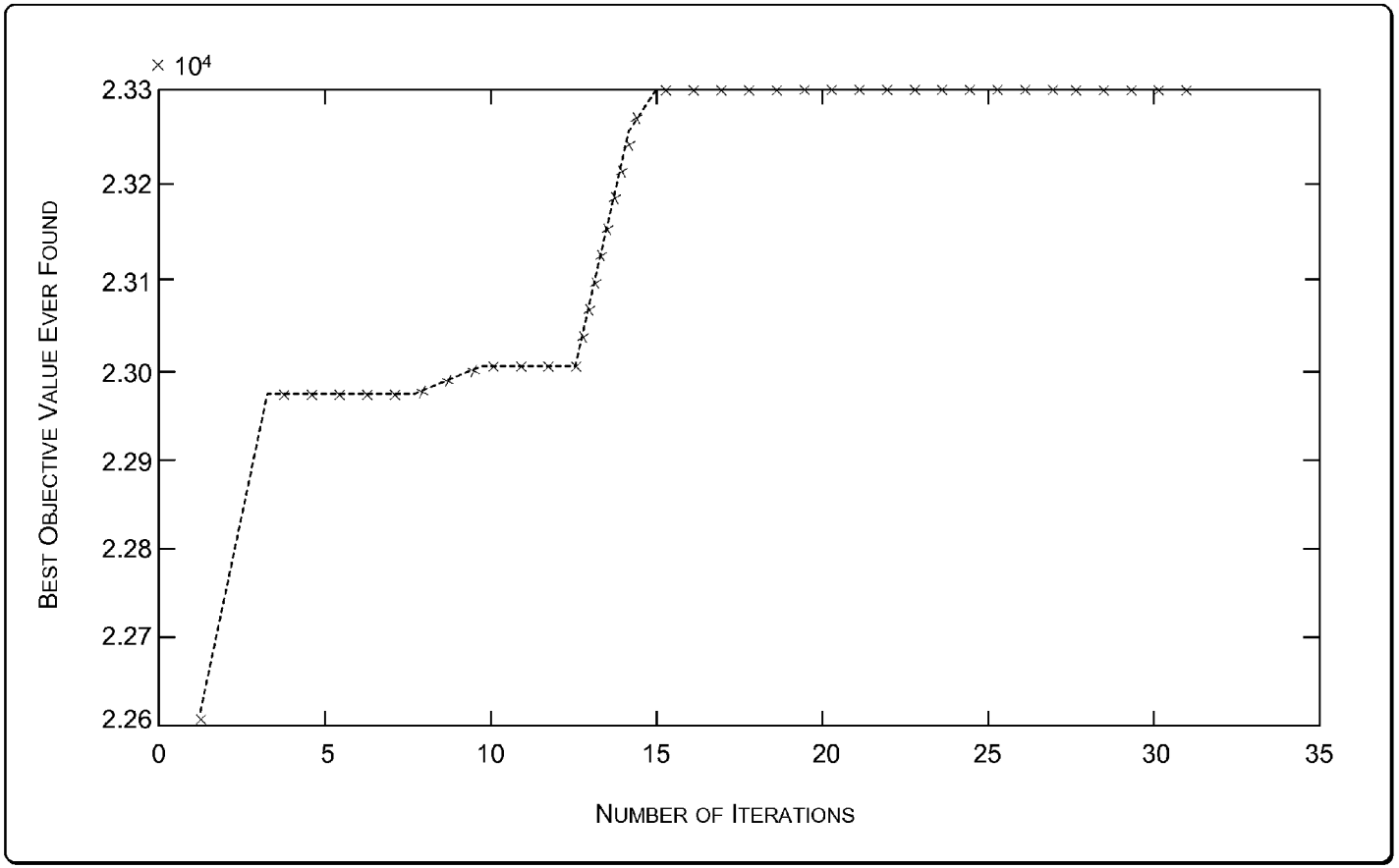
FIG. 10 is a diagram of current best objective values versus number of iterations, from an example simulated annealing algorithm.

With selected annealing parameters, a single test run called the NLP solver 30 times. The best objective function value was found at the 14th iteration, which resulted in only a 0.86% optimality gap with respect to the optimally obtained value. FIG. 10 demonstrates the best objective function value found at each iteration. As shown in FIG. 10, the simulated annealing algorithm improves the objective function value significantly at the first iteration, where the initial solution is obtained through a randomized starting point. In one test case, it required only 25 seconds for a single run to finish. Compared to the BARON solver 606, which found the global optimum in 2 minutes and 26 seconds, the computational time required by the proposed annealing algorithm is significantly lower, while the solution obtained is only marginally different.

Figure 11:
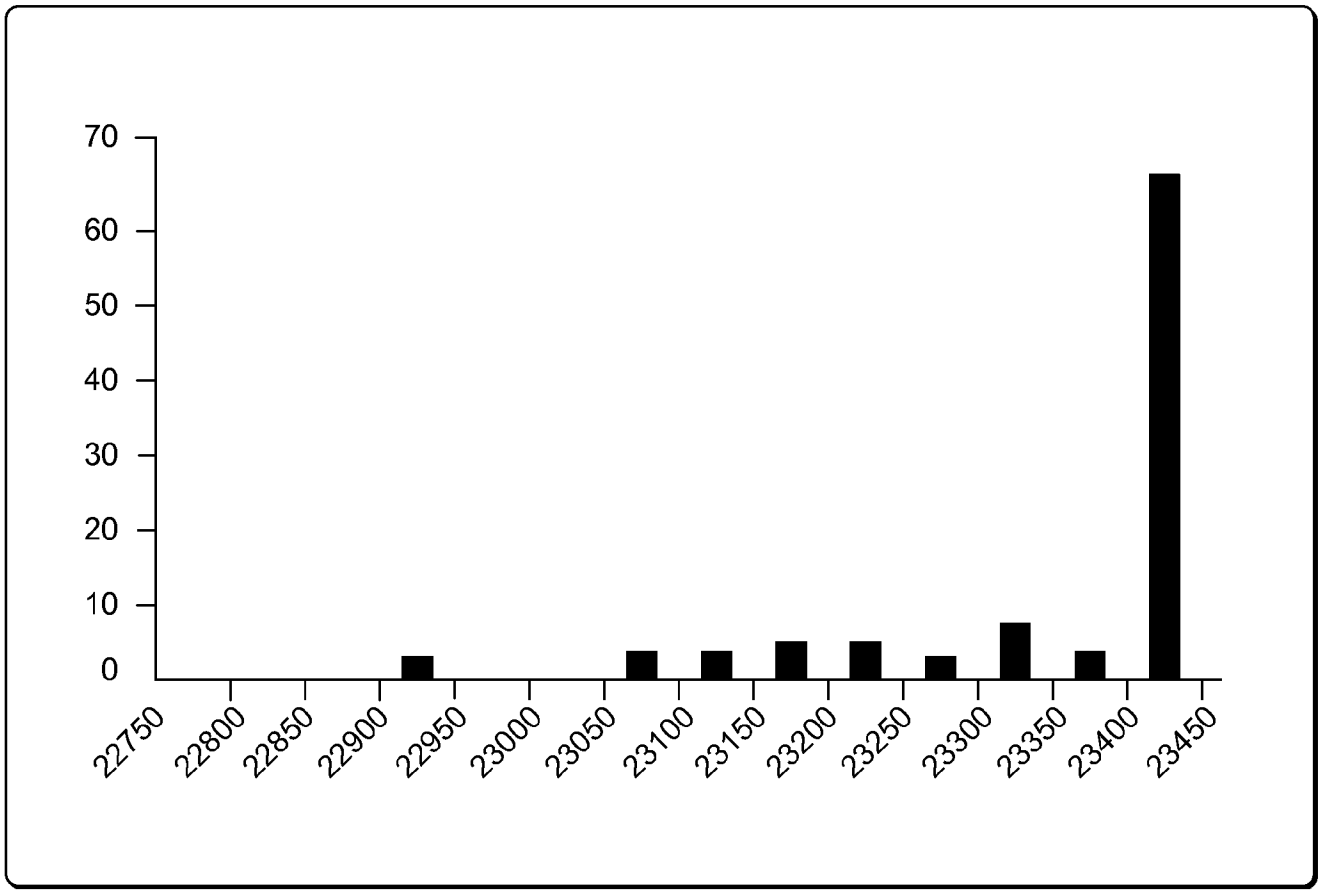
FIG. 11 is a histogram showing distribution of objective values from the simulated annealing algorithm.

To build confidence in the proposed model, the model was executed 100 times with the same annealing parameters. Of these, 39% of the test runs resulted in the global optimal solution. The worst objective value out of the 100 experiments was only 2% away from the optimal solution. A histogram of the objective function values obtained is presented in FIG. 11, with statistics given below:

| Statistics for Best Objective Function Value (Stb) | |
|---|---|
| Minimum | 22,852 |
| Mean (μ) | 23,299 |
| Median | 23,367 |
| Standard Deviation (σ) | 132 |
| Coefficient of Variation (σ/μ) | 0.57% |

As a result, it was evident that the simulated annealing algorithm for use in the annealer 414 is quite effective for Buitrago's 56-well case, both in terms of quality of solution and the time taken to obtain the solution.

4. Gas-Lift Optimization Problem—Extended Model

In this section, the basic model is extended by considering a richer set of production curves as well as operating constraints such as the gas/oil ratio (GOR) and liquid constraints at several manifolds 122 in a production network. Furthermore, the steady-state solution obtained from a network is now addressed, in which the separate productions of the individual wells are now interdependent.

First, the offline problem, or MINLP model 410, was formulated by the modeler 408. The production curves 406 were categorized and a MINLP model 410 was formulated based on the curve descriptions. In one implementation, the offline-online technique iterates over the wellhead pressure profile and defines the stopping criterion. Finally, new techniques used in the constraint scaler 424 match the online problem and the offline problem in the presence of operating constraints.

Figure 12:
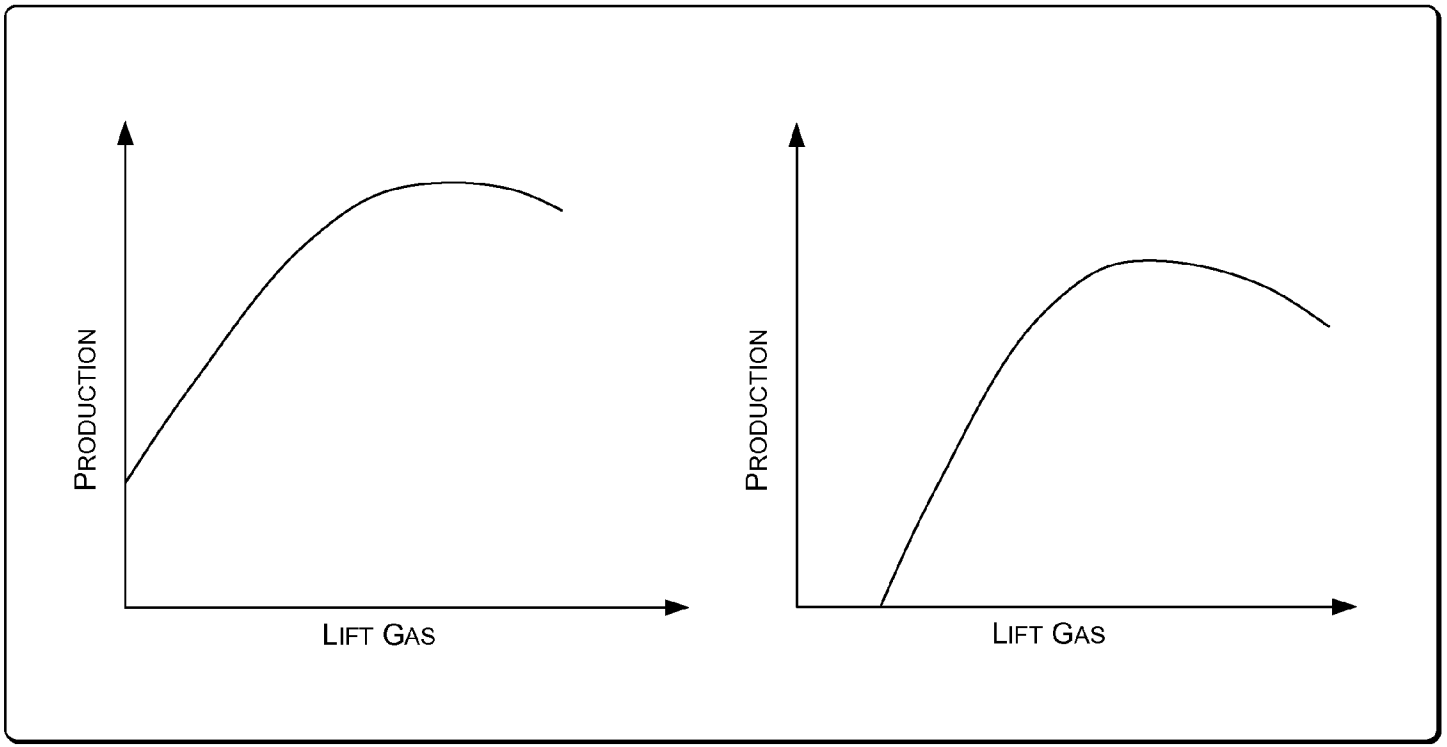
FIG. 12 is a diagram of smooth production curves for instantaneous flowing (IF) and non-instantaneous flowing (NIF) wells.

The offline problem requires a gas-lift performance curve(s) (GLPC) 406 for each well 110. A GLPC 406 is the production curve of a well ignoring all the other wells in the network. The GLPC 406 of a well can take several forms. Based on the well behavior observed in several test cases, the following four categories of well curves can be defined:

IF Wells: Instantaneous flowing wells with smooth production curve (see FIG. 12)

NIF Wells: Non-instantaneous flowing wells with smooth production curve (see FIG. 12)

Kinked IF: Instantaneous flowing wells with non-smooth production curve (see FIG. 13)

Kinked NIF: Non-instantaneous flowing wells with non-smooth production curve (see FIG. 13)

Figure 13:
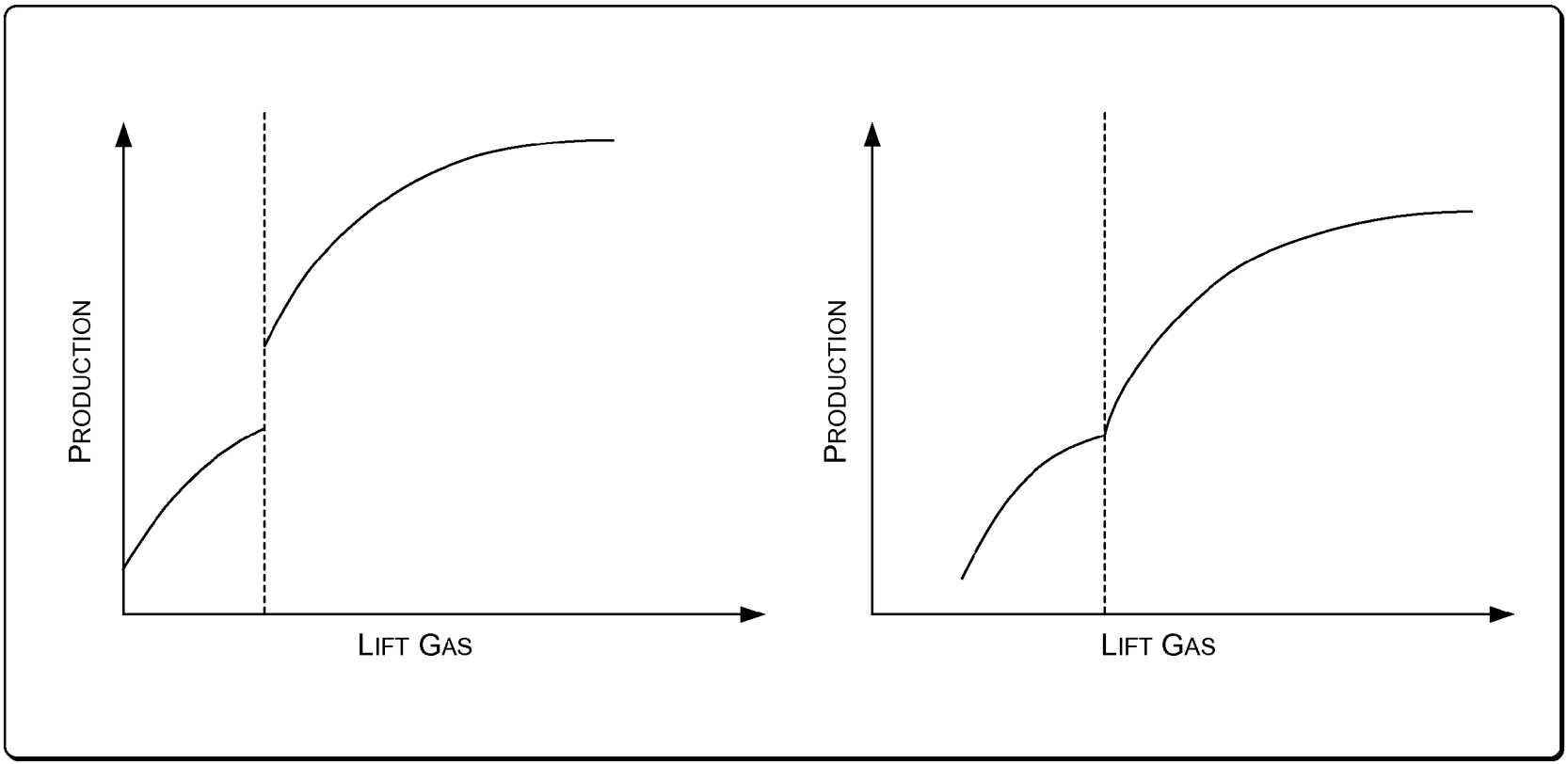
FIG. 13 is a diagram of non-smooth production curves for instantaneous flowing (IF) and non-instantaneous flowing (NIF) wells.

Kinks can be due to the non-existence of the first derivative, or a point of inflection, or a discontinuity. FIG. 13 illustrates such behavior.

Four sets are defined, IF, NIF, kIF, and kNIF, which refer to IF Wells, NIF Wells, Kinked IF Wells and Kinked NIF Wells, respectively.

Let $x_i$ denote the allocation to well i. Let $q_i(x_i)$ denote the production function of well i. For $i \in$ IF, $q_i(x_i)=g_i(x_i)$, which is a smooth curve. For $i \in$ NIF, there exists some $l_i>0$ such that:

$$q_i(x_i) = \begin{cases} 0 & \text{if } x_i < l_i \\ g_i(x_i) & \text{if } x_i \geq l_i \end{cases} \tag{10}$$

For $i \in$ kIF, there exist smooth curves, $g_i^1(x_i)$ and $g_i^2(x_i)$ and some $m_i>0$ such that $$q_i(x_i) = \begin{cases} g_i^1(x_i) & \text{if } x_i < m_i \\ g_i^2(x_i) & \text{if } x_i \geq m_i \end{cases} \tag{11}$$

And finally, for $i \in$ kNIF, there exist smooth curves $g_i^1(x_i)$ and $g_i^2(x_i)$ and some $m_i>l_i>0$ such that $$q_i(x_i) = \begin{cases} 0 & \text{if } x_i < l_i \\ g_i^1(x_i) & \text{if } l_i \leq x_i < m_i \\ g_i^2(x_i) & \text{if } x_i \geq m_i \end{cases} \tag{12}$$

4.1 Curve Fitting Methodology

As identified earlier, the ideal is to fit curves to the data, which fall into one of the categories IF, NIF, kIF and kNIF. Curve fitting can be done manually for a small size problem, however, a computer code that recognizes the pattern of curves is necessary for large scale problems. In this section, such a computer algorithm and its underlying assumptions are described.

Notation: The function $f_i(x_i|p_i)$ denotes the production curve of well i as a function of the lift-gas $x_i$ given a fixed wellhead pressure $p_i$ 212.

Assumption 1. There exist thresholds $\underline{x}_i(p)$ and $\overline{x}_i(p)$ such that $f_i(x_i|p_i)=0$ for $x_i<\underline{x}_i(p)$, $f_i(x_i|p_i)$ is linear for $\underline{x}_i(p)\leq x_i<\overline{x}_i(p)$ and $f_i(x_i|p_i)$ is concave for $x_i\geq\overline{x}_i(p)$.

Thus, $f_i(x_i|p_i)$ is linear on $[\underline{x}_i(p),\overline{x}_i(o))$ and concave on $[\underline{x}_i(p),\infty)$. The function $f_i(x_i|p_i)$ may or may not be continuous at $\underline{x}_i(p)$ and $\overline{x}_i(p)$.

Figure 14:
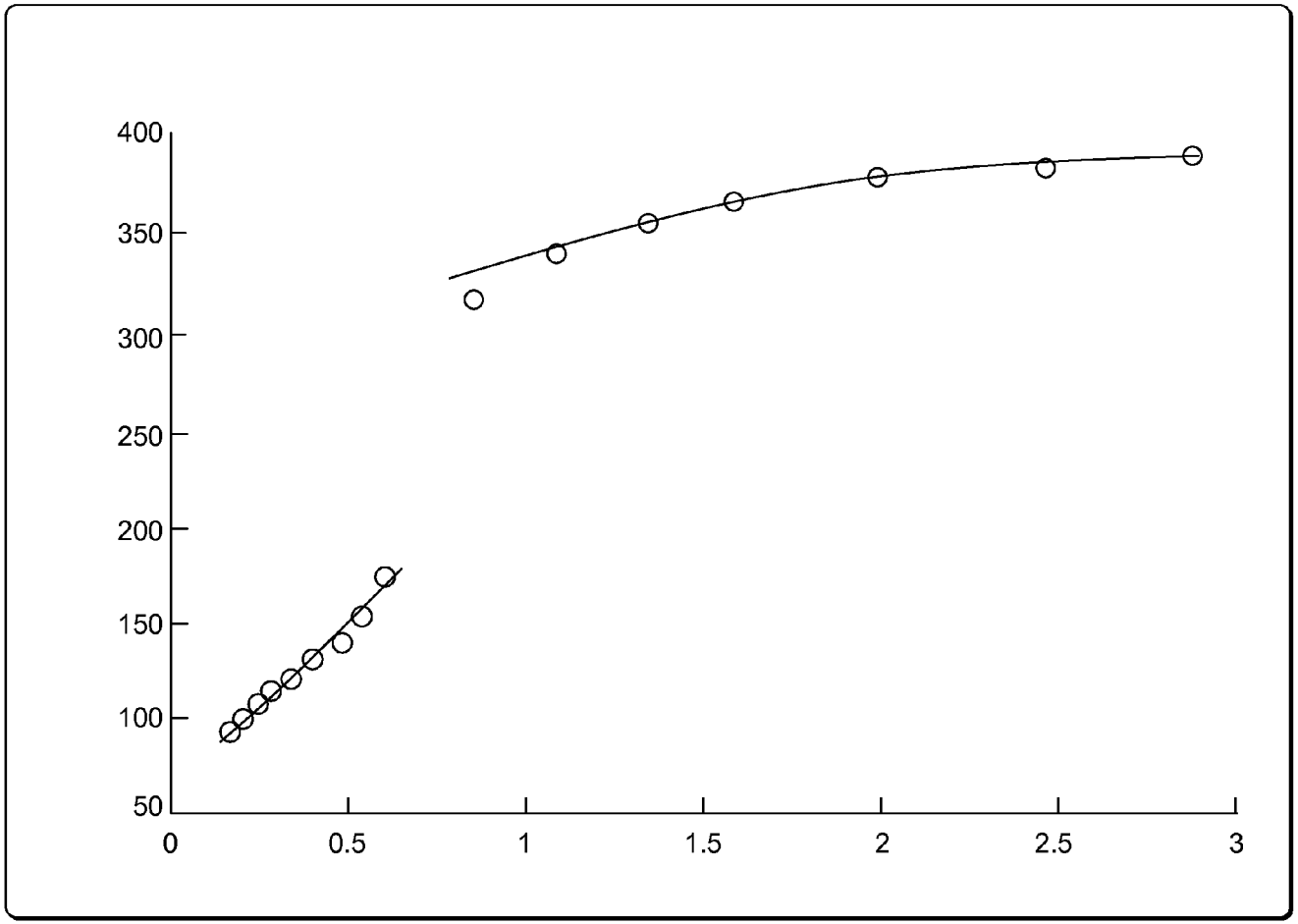
FIG. 14 is a diagram of a fitted curve as placed on well data.

Conditions that qualify a well for a category are listed below. An example curve fitted for a well at an example wellhead pressure of 395.01 psi is illustrated in FIG. 14.

| Category | Conditions |
|---|---|
| IF | $\underline{x}_i(p) = \overline{x}_i(p) = 0$ |
| kIF | $\underline{x}_i(p) = 0, \overline{x}_i(p) > 0$ |
| NIF | $\underline{x}_i(p) = \overline{x}_i(p) > 0$ |
| kNIF | $0 < \underline{x}_i(p) < \overline{x}_i(p)$ |

4.2 Offline Problem Formulation

The offline problem is formulated as a MINLP model 410. The following decision variables and parameters are defined:

| | |
|---|---|
| $x_i$ | Allocation on well i |
| $y_i$ | Indicates if a NIF or a kNIF well is open |
| $l_i$ | Lower bound on allocation to well i |
| $u_i$ | Upper bound on allocation to well i |
| $m_i$ | The point at which $q_i(x_i)$ changes functional form |
| $y_i^r$ | Indicates the region over which $x_i$ takes values, $y_i^r = 1$ if $m_i \geq x_i \geq u_i$ and otherwise $y_i^r = 0$. |

The most general well is a kNIF. So, the production function of all the wells is formulated in a manner similar to a kNIF well.

$$q_i(x_i|y_i, y_i^T)=g_i^1(x_i)y_i^r y_i+g_i^2(x_i)(1-y_i^r)y_i \tag{13}$$

For IF and NIF wells, $g_i^1(x_i)\equiv 0$ and $g_i^1(x_i)=g_i(x_i)$ and $m_i\equiv l_i$. Based on these definitions, the offline problem is formulated as a MINLP model 410 as follows.

$$\text{maximize} \sum_{i=1}^{n} u_i q_i - c_g \sum_{i=1}^{n} x_i \tag{14}$$

$$\text{subject to} \sum_{i=1}^{n} x_i \leq C \tag{15}$$

-continued $$q_i = g_i^1(x_i)y_i^r y_i + g_i^2(x_i)(1 - y_i^r)y_i \quad i = 1, 2, \ldots, n \tag{16}$$

$$x_i \geq m_i y_i^r y_i + l_i(1 - y_i^r)y_i \quad i = 1, 2, \ldots, n \tag{17}$$

$$x_i = \leq u_i y_i^r y_i + m_i(1 - y_i^r)y_i \quad i = 1, 2, \ldots, n \tag{18}$$

$$Uq + Vx \leq W \tag{19}$$

$$y_i, y_i^r \in \{0, 1\} \quad i = 1, 2, \ldots, n \tag{20}$$

where, $v_i$ is the value of liquid flowing through well i and $c_g$ is the unit cost of the lift-gas 216. U, V and W are matrices that describe the operating constraints imposed; q is a vector of the liquid rates and x is the vector of the $x_i$'s. A more detailed explanation of the role of these constants and matrices is provided below.

| | |
|---|---|
| $p_o$ | Profit per barrel of oil |
| $c_w$ | Cost processing a barrel of water |
| $p_g$ | Profit per unit of gas produced |
| $c_g$ | Cost of injecting unit of gas |
| $GOR_i$ | Gas to Oil Ratio at Well i |
| $W\ Cut_i$ | Water Cut at Well i |
| $q_i$ | Liquid rate at Well i |
| $q_i^o$ | Oil produced at Well i |
| $q_i^w$ | Water produced at Well i |
| $q_i^g$ | Gas produced at Well i |
| $q_i^{gTotal}$ | Total Gas produced at Well i |

where the following relationships hold:

$$q_i^w = WCut_i q_i \tag{21}$$

$$q_i^o = (1 - WCut_i)q_i \tag{22}$$

$$q_i^g = GOR_i q_i^o \tag{23}$$

$$= GOR_i(1 - WCut_i)q_i \tag{24}$$

$$q_i^{gTotal} = q_i^g + x_i \tag{25}$$

$$= GOR_i(1 - WCut_i)q_i + x_i \tag{26}$$

The monetary value of a barrel of liquid produced at well i can be estimated with the following constant.

$$v_i = p_0(1 - WCut_i) - c_w WCut_i + p_g GOR_i(1 - WCut_i) \tag{27}$$

Thus, the offline MINLP model 410 has been formulated as a profit maximization problem. When the objective is to maximize the total liquid rate or the oil-rate, then $v_i=1$ for all i and $c_g=0$ for the liquid rate maximization problem and $v_i=1-WCut_i$ for all i and $c_g=0$ for the oil-rate maximization problem.

Next, handling of the operating constraints is described. Let M denote a set of wells, which are connected to the same manifold 122. The following constraints specify a maximum liquid rate, maximum oil rate, maximum water rate and maximum free gas on the manifold 122.

$$\sum_{i \in M} q_i \leq q_l^{max} \tag{28}$$

$$\sum_{i \in M} (1 - WCut_i)q_i \leq q_o^{max} \tag{29}$$

-continued $$\sum_{i \in M} WCut_i q_i \leq q_w^{max} \tag{30}$$

$$\sum_{i \in M} GOR_i(1 - WCut_i)q_i + \sum_{i \in M} x_i \leq q_g^{max} \tag{31}$$

The matrices U, V and W contain all the information regarding the operating constraints.

The number of binary variables in the offline problem 410 is potentially increased in the extended formulation. Hence, an enumeration scheme is used when the number of binary variables is reasonable and the simulated annealing approach for the annealer 414 is used when the number of variables exceeds a threshold.

4.3 Iterative Procedure with Offline-Online Method

The offline-online method described above and in the Rashid reference cited above is utilized. The offline-online approach can be summarized in the following algorithm.

Offline-online Procedure:

```
Let P = P0.
Select ϵ0.
Let ϵ = ϵ0 + 1.
while ϵ > ϵ0 do
    Let Pold = P.
    Fit curves to pre-generated lift data for P.
    Solve the offline problem.
    Plug the offline solution in the network simulator.
    Let P be the pressure profile returned by the network simulator.
    Let ϵ = ||P − Pold||.
end while
```

Ideally, wells connected to the same manifold 122 should have the same wellhead pressure 212 once the network simulator 420 is run. However, the network simulator 420 tolerates small errors in the computation and may return slightly different wellhead pressures 212 for wells connected to the same manifold 122. This creates an instability in the offline-online procedure, which may require more time to find the optimal lift-gas 216 allocation. To solve this, the pressure values smoother 422 may even out the pressure profile of wells connected to the same manifold 122 in the following manner.

Let M be a set of wells connected to the same manifold 122. For convenience, these wells can be indexed by 1, 2, . . . , M. Let $(P_1, P_2, \ldots, P_M)$ denote the wellhead pressure profile 212 returned by the network simulator 420. Ideally, these numbers should be the same. However, in practice these numbers are close to, but slightly different from each other. Let $\overline{P}=(P_1+P_2+\ldots+P_M)/M$ denote the average wellhead pressure 212. When calling the offline problem 410, the pressure values smoother 422 uses $(\overline{P}, \overline{P}, \ldots, \overline{P})$ rather than $(P_1, P_2, \ldots, P_M)$ to enhance the stability of the offline-online procedure. The term $\overline{P}$ denotes the modified pressure profile based on averaging across all manifolds 122.

A mismatch between the online problem 412 and offline problem 410 arises when operating constraints are introduced. Let $q_i$ and $Q_i$ denote the liquid rate of well i returned by the offline procedure 410 and online procedure 412 respectively. Ideally, $q_i=Q_i$ at convergence. However, there may be mismatches for several reasons. One reason is that the MINLP solving engine 418 may apply an affine interpolation when no lift curve is available. Second, there may be mismatches due to curve fitting procedures. The fitted curves can be slightly different from the actual data. Global/local correlations can also differ. Local correlations are used for GLPC 406 extraction, while global correlations are used for the network solution. If these are not consistent, significant variation can arise between the online solution 412 and the offline solution 410. And finally, there can be network effects, which impact the production of the individual well. For all these reasons, the constraints formulated offline may not be a good representation of the constraints online. To overcome this issue, the constraint scaler 424 adjusts the offline constraints at each iteration.

Let $u_{ij}$ denote an entry in matrix U, which is the coefficient of $q_j$ in the ith operating constraint. Let $q_j^{old}$ and $Q_j^{old}$ denote the values of the offline liquid rate and the online liquid rate in the previous iteration. Then $u_{ij}$ is modified by multiplying it by $Q_j^{old}/q_j^{old}$. This provides the following:

$$\tilde{u}_{ij}q_j = u_{ij}\left(\frac{Q_j^{old}}{q_j^{old}}\right)q_j \tag{32}$$

$$\cong u_{ij}\left(\frac{Q_j}{q_j}\right)q_j = u_{ij}Q_j \tag{33}$$

As a result, a solution returned by the offline procedure 410 is expected to be online-feasible. Now, a modified offline-online procedure can be formulated.

Modified Offline-online Procedure:

Plug $x = x_0$, a vector of initial lift-gas allocation to wells in the network simulator and read $P = P_0$.
Let $\tilde{P}$ be the modified pressure profile based on averaging across all manifolds.
Let $\hat{U} = U$. (Offline constraints are initially set to online constraints).
Select $\epsilon_0$.
Let $\epsilon = \epsilon_0 + 1$.
while $\epsilon > \epsilon_0$ do
  Let $P_{old} = \tilde{P}$.
  Fit curves to pre-generated lift data for $\tilde{P}$.
  Solve the offline problem with constraint matrix $\hat{U}$.
  Let q, be the liquid rate for well i returned by the offline procedure.
  Plug the offline solution in the network simulator.
  Let P be the pressure profile returned by the network simulator.
  Let $Q_i$ be the liquid rate for well i returned by the online procedure.
  Let $\tilde{P}$ be the modified pressure profile based on averaging across all manifolds.
  Let $\hat{u}_{ij} = u_{ij}Q_i/q_i$ for all i and j. (If $q_i = 0$, let $\tilde{u}_{ij} = u_{ij}$).
  Let $\epsilon = ||\tilde{P} - P_{old}||$.
end while 4. Case Studies The new, iterative, MINLP technique can be applied on various test cases, which include 2, 4, 26 and 100 wells, respectively. The result can be compared to the performance in the Rashid reference. Each problem can be solved for liquid rate maximization and the online objective value at convergence is reported in Table 4, with the corresponding number of simulator calls reported in Table 5. Initially, no operating constraints were imposed. In the following tables, MINLP refers to the results produced by the exemplary MINLP iterative technique and GLO refers to the gas-lift optimization results reported in the above-cited Rashid reference.

TABLE 4

Online Objective Value (Stb) at Convergence

| | MINLP | GLO | Gap |
|---|---|---|---|
| 2 Well | 2,836 | 2,837 | 0.04% |
| 4 Well | 5,759 | 5,762 | 0.05% |
| 100 Well | 27,336 | 27,365 | 0.11% |
| 26 Well | 45,838 | 45,905 | 0.15% |

Table 4 indicates that the new MINLP approach produces comparable results to GLO. The exemplary MINLP results are slightly lower than GLO results because of the differences in the data fitting methodology. The MINLP model 410 fits a parabola, whereas the Rashid reference fits splines to data. Although splines can provide a better fit to the data, they are not suitable for the MINLP formulation 410. It can be concluded that fitting parabolas helps increase modeling efficiency, while producing comparable results.

TABLE 5

Number of Simulator Calls

| | MINLP | GLO |
|---|---|---|
| 2 Well | 2 | 3 |
| 4 Well | 2 | 4 |
| 100 Well | 3 | 8 |
| 26 Well | 3 | 4 |

Table 5 indicates that the MINLP model 410 converges to a solution in fewer function evaluations compared to GLO. Averaging the pressures across a manifold 122 plays a very significant role in these favorable results. This demonstrates that the averaging performed by the pressure values smoother 422 increases the stability of the new MINLP model 410 without sacrificing solution quality.

Next, constraints are introduced into the MINLP model 410 and results compared with those obtained in the Rashid reference. The Rashid reference analyzes the constrained version of the four-well case. Table 6 compares the results for four cases between GLO and the MINLP model 410. Each constraint is defined as a free-gas constraint on a branch.

TABLE 6

Online Objective Value (Stb) at Convergence

| | MINLP | GLO | Improvement |
|---|---|---|---|
| $B_3 \leq 2$ | 5,765.78 | 5,694.66 | 1.25% |
| $B_2 \leq 2, B_3 \leq 2$ | 5,765.78 | 5,637.42 | 2.28% |
| $B_3 \leq 2, B_1 \leq 3.8$ | 5,739.47 | 5,591.10 | 2.65% |
| $B_3 \leq 1.5, B_1 \leq 3.8$ | 5,739.47 | 5,479.69 | 4.74% |

At convergence, all of the online constraints hold with equality in the MINLP procedure 410. In the procedure proposed by the Rashid reference, some constraints do not hold with equality, which results in an optimality gap. As Table 6 indicates, the solution is improved with the MINLP approach 410. Thus, applying the constraint scaler 424 to modify/adapt the offline constraints to meet the online constraints makes the MINLP model 410 more accurate and produces better results.

Another advantage of using the MINLP model 410 over GLO is the reduction in the number of simulator calls for constrained cases. The number of function evaluations by GLO is not recorded, but it is expected to be multiples of the unconstrained case.

TABLE 7

| Number of Simulator Calls | | |
|---|---|---|
| | MINLP | GLO |
| $B_3 \leq 2$ | 3 | 3 |
| $B_2 \leq 2, B_3 \leq 2$ | 3 | N/A |
| $B_3 \leq 2, B_1 \leq 3.8$ | 3 | N/A |
| $B_3 \leq 1.5, B_1 \leq 3.8$ | 2 | N/A |

5. Well Activation/Deactivation Strategies

Some wells may be shut down by the offline MINLP procedure 410 to meet operating constraints. When the offline solution is plugged into the online problem 412, the network simulator 420 will then return a zero wellhead pressure 212 for the well that is shut down. In the subsequent offline procedure 410 performed by the MINLP solving engine 418, the well may be considered deactivated or can be reactivated. To assess the consequence of reactivating a well, there is no curve available to use when the wellhead pressure 212 is zero. To overcome this, the well deactivator-reactivator 426 may extract the manifold pressure and use this manifold pressure as a proxy for the wellhead pressure 212. The physical interpretation of this technique is that a well in the online problem 412 has zero flow, since the wellhead and manifold pressures are treated as being equal. More importantly, this technique provides an operating wellhead pressure 212 for the well in the offline problem 410.

In some cases, the well deactivator-reactivator 426 may deactivate a well to improve production from other wells. However, the offline representation 410 of the problem is not always able to capture this benefit. For this reason, the well deactivator-reactivator 426 may revise the offline-online procedure by ranking the wells at convergence based upon a metric, and then deactivate the well with the lowest rank. Then, the modified offline-online method is repeated with the lowest ranking well omitted. This procedure can be continued until eliminating the lowest ranking well does not improve the objective function value. The revised iterative procedure is described below.

Revised Offline-online Procedure:

```
Plug x = x_0, a vector of initial lift-gas allocation to wells in the network
simulator and read P = P_0.
Let P̃ be the modified pressure profile based on averaging across all
manifolds.
Let Ũ = U. (Offline constraints are initially set to online constraints).
Select ε_0.
Let z = 0.
Continue=1 .
while Continue=1 do
    Let z_old = z.
    Let ε = ε_0 + 1.
  while ε > ε_0 do
        Let P_old = P̃.
        Fit curves to pre-generated lift data for P̃.
        Solve the offline problem with constraint matrix Ũ.
        Let q_i be the liquid rate for well i returned by the offline
        procedure.
        Plug the offline solution in the network simulator.
        Let P be the pressure profile returned by the network simulator.
        Let Q_i be the liquid rate for well i returned by the online
        procedure.
        Let P̃ be the modified pressure profile based on averaging across
all
      manifolds.
      if P̃(i) = 0 for well i then
        if Well i is permanently deactivated then
          Set the production curve to zero.
```

-continued

Revised Offline-online Procedure:

```
        else
          P̃(i) =Manifold Pressure
        end if
      end if
        Let ũ_ij = u_ij Q_i/q_i for all i and j. (If q_i = 0,
        let ũ_ij = u_ij).
        Let ε = ||P − P_old||.
  end while
    Let z be the current online objective value.
  if z > z_old then
    Permanently deactivate the well with the lowest rank
  else
    Continue=0
  end if
end while
```

When this revised offline-online procedure is applied to the 26-Well case with various objective criteria, the results are reported in Table 8.

TABLE 8

| Number of Simulator Calls | | | |
|---|---|---|---|
| | Objective Criterion | | |
| | Liquid Rate | Oil Rate | Profit |
| Liquid Rate (stb) | 45,838 | 45,460 | 42,105 |
| Oil Rate (stb) | 38,758 | 38,792 | 38,444 |
| Profit ($) | 2,575,449 | 2,581,257 | 2,583,033 |
| Inactive Wells | None | W03 | W03, W22 |
| Simulator Calls | 5 | 5 | 5 |

As Table 8 indicates, the number of simulator calls increases by two compared with the earlier modified offline-online procedure. The exact same solution is obtained for the liquid maximization problem. However, the revised offline-online procedure obtains better results for the oil maximization and profit maximization problems, as the previous approach could not capture the activation state of wells for optimality.

Next, the new revised offline-online procedure can be applied to the 26-Well case with various operating constraints. Liquid and free gas constraints were imposed on all four branches and liquid, oil, water and free gas constraints at the sink. The revised offline-online procedure solved for various objective function criteria. Tables 9-11 summarize the results for the constrained cases for liquid, oil and profit objective functions.

As Tables 9-11 indicate, the number of simulator calls is not increased dramatically. Yet, the revised procedure is able to return the best solution that satisfies all the constraints imposed. This also shows that the constraint scaler 424 is effective.

TABLE 9

| Constrained 26-Well Case - Liquid Maximization Problem | | | | | |
|---|---|---|---|---|---|
| | Entity | Constraint Type | Constrained Imposed | Uncon-strained Solution | Constrained Solution |
| 1 | Branch 1 | Gas | 20 | 24.99 | 19.99 |
| 2 | Branch 2 | Gas | 12 | 15.97 | 11.96 |
| 3 | Branch 4 | Gas | 18 | 20.55 | 15.93 |
| 4 | Branch 6 | Gas | 15 | 17.14 | 13.98 |
| 5 | Branch 1 | Liquid | 14,000 | 15,086 | 13,985 |

TABLE 9-continued

Constrained 26-Well Case - Liquid Maximization Problem

| | Entity | Constraint Type | Constrained Imposed | Uncon-strained Solution | Constrained Solution |
|---|---|---|---|---|---|
| 6 | Branch 2 | Liquid | 12,000 | 12,788 | 11,884 |
| 7 | Branch 4 | Liquid | 12,000 | 12,273 | 11,083 |
| 8 | Branch 6 | Liquid | 15,000 | 17,973 | 15,003 |
| 9 | Sink | Liquid | 41,000 | 45,847 | 40,871 |
| 10 | Sink | Oil | 36,000 | 38,765 | 33,652 |
| 11 | Sink | Water | 8,000 | 7,082 | 7,220 |
| 12 | Sink | Gas | 48 | 58 | 46 |
| 13 | Network | Lift Gas | 45 | 45 | 35 |
| Obj. Value | | | | 45,847 | 40,871 |
| Sim. Calls | | | | 5 | 8 |

Oil, Water and Liquid rates (Stb), Gas-rates (Mmscfd), Obj. Value (Stb)

TABLE 10

Constrained 26-Well Case - Oil Maximization Problem

| | Entity | Constraint Type | Constrained Imposed | Uncon-strained Solution | Constrained Solution |
|---|---|---|---|---|---|
| 1 | Branch 1 | Gas | 20 | 24.28 | 20.00 |
| 2 | Branch 2 | Gas | 12 | 16.12 | 12.05 |
| 3 | Branch 4 | Gas | 18 | 20.92 | 17.00 |
| 4 | Branch 6 | Gas | 15 | 17.72 | 15.00 |
| 5 | Branch 1 | Liquid | 14,000 | 14,696 | 12,466 |
| 6 | Branch 2 | Liquid | 12,000 | 12,793 | 12,361 |
| 7 | Branch 4 | Liquid | 12,000 | 12,307 | 10,001 |
| 8 | Branch 6 | Liquid | 15,000 | 17,971 | 14,610 |
| 9 | Sink | Liquid | 41,000 | 45,460 | 39,437 |
| 10 | Sink | Oil | 36,000 | 38,792 | 36,176 |
| 11 | Sink | Water | 8,000 | 6,668 | 3,261 |
| 12 | Sink | Gas | 48 | 58 | 47 |
| 13 | Network | Lift Gas | 45 | 45 | 35 |
| Obj. Value | | | | 38,792 | 36,176 |
| Sim. Calls | | | | 5 | 12 |

Oil, Water and Liquid rates (Stb), Gas-rates (Mmscfd), Obj. Value (Stb)

TABLE 11

Constrained 26-Well Case - Profit Maximization Problem

| | Entity | Constraint Type | Constrained Imposed | Uncon-strained Solution | Constrained Solution |
|---|---|---|---|---|---|
| 1 | Branch 1 | Gas | 20 | 25.63 | 17.98 |
| 2 | Branch 2 | Gas | 12 | 16.30 | 12.01 |
| 3 | Branch 4 | Gas | 18 | 21.71 | 17.08 |
| 4 | Branch 6 | Gas | 15 | 16.07 | 14.94 |
| 5 | Branch 1 | Liquid | 14,000 | 14,713 | 11,828 |
| 6 | Branch 2 | Liquid | 12,000 | 12,806 | 11,032 |
| 7 | Branch 4 | Liquid | 12,000 | 12,320 | 11,828 |
| 8 | Branch 6 | Liquid | 15,000 | 14,585 | 13,807 |
| 9 | Sink | Liquid | 41,000 | 42,105 | 36,667 |
| 10 | Sink | Oil | 36,000 | 38,444 | 35,968 |
| 11 | Sink | Water | 8,000 | 3,661 | 700 |
| 12 | Sink | Gas | 48 | 58 | 45 |
| 13 | Network | Lift Gas | 45 | 45 | 33 |
| Obj. Value | | | | 2,583,033 | 2,439,838 |
| Sim. Calls | | | | 5 | 12 |

Oil, Water and Liquid rates (Stb), Gas-rates (Mmscfd), Obj. Value ($)

6. Joint Gas-Lift and Choke Control Problem

In this section, the gas-lift optimization problem is extended by introducing choke control. A choke 116 is basically a valve that limits the flow of the liquid (fluid). A choke can be set to a number of positions, such as fully open, half open, quarter open, and closed. Let C denote the set of the positions (settings) that the choke can be set to. Without loss of generality, the choke positions can be labeled with integers, i.e., C={0, 1, 2, . . . , k}, where 0 refers to fully closed and k refers to fully open. Hence, there are k+1 positions that the choke 116 can be set to. A number of variables and parameters are now defined.

Let $y_{i,cp}$ be a binary variable indicating whether the choke 116 belonging to well i is set to position cp, where cp ϵ C.

$$\text{maximize} \sum_{i=1}^{n} u_i q_i - c_g \sum_{i=1}^{n} x_i \tag{34}$$

$$\text{subject to} \sum_{i=1}^{n} x_i \le C \tag{35}$$

$$q_i = \sum_{cp=1}^{k} [g_{i,cp}^1(x_i) y_i^r + g_{i,cp}^2(x_i)(1 - y_i^r)] y_{i,cp} \quad i = 1, 2, \ldots, n \tag{36}$$

$$x_i \ge \sum_{cp=1}^{k} m_{i,cp} y_{i,cp} y_i^r + \sum_{cp=1}^{k} l_{i,cp} y_{i,cp} (1 - y_i^r) \quad i = 1, 2, \ldots, n \tag{37}$$

$$x_i \le \sum_{cp=1}^{k} u_{i,cp} y_{i,cp} y_i^r + \sum_{cp=1}^{k} m_{i,cp} y_{i,cp} (1 - y_i^r) \quad i = 1, 2, \ldots, n \tag{38}$$

$$\sum_{cp=1}^{k} y_{i,cp} \le 1 \quad i = 1, 2, \ldots, n \tag{39}$$

$$Uq + Vx \le W \tag{40}$$

$$y_{i,cp} \in \{0, 1\} \quad i = 1, 2, \ldots, n \tag{41}$$

$$cp = 1, 2, \ldots, k \tag{42}$$

$$y_i^r \in \{0, 1\} \quad i = 1, 2, \ldots, n \tag{43}$$

The formulation with the revised offline-online procedure can be tested on the constrained 26-Well case for profit maximization. Previously, the offline-online procedure assumed a fixed choke position of two inches in each well. In one implementation, the revised offline-online procedure can allow each choke 116 to take positions with values from the discrete set {0, 1, 1.25, 1.5, 1.75, 2}. Results obtained from running the revised offline-online procedure are summarized in Table 12. Table 13 indicates the choke positions before and after the introduction of choke control.

As Table 13 indicates, the number of inactive wells is reduced by one (W01) when intermediate values are allowed for the choke

TABLE 12

Constrained 26-Well Case with Dual Control for Profit Maximization

| | Entity | Constraint Type | Constrained Imposed | Solution with Fixed Choke | Solution with Dual Control |
|---|---|---|---|---|---|
| 1 | Branch 1 | Gas | 20 | 17.98 | 20.00 |
| 2 | Branch 2 | Gas | 12 | 12.01 | 12.01 |

TABLE 12-continued

Constrained 26-Well Case with Dual Control for Profit Maximization

| | Entity | Constraint Type | Constrained Imposed | Solution with Fixed Choke | Solution with Dual Control |
|---|---|---|---|---|---|
| 3 | Branch 4 | Gas | 18 | 17.98 | 18.00 |
| 4 | Branch 6 | Gas | 15 | 14.94 | 14.78 |
| 5 | Branch 1 | Liquid | 14,000 | 11,828 | 11,987 |
| 6 | Branch 2 | Liquid | 12,000 | 11,032 | 10,969 |
| 7 | Branch 4 | Liquid | 12,000 | 11,828 | 11,830 |
| 8 | Branch 6 | Liquid | 15,000 | 13,807 | 13,805 |
| 9 | Sink | Liquid | 41,000 | 36,667 | 36,760 |
| 10 | Sink | Oil | 36,000 | 35,968 | 36,014 |
| 11 | Sink | Water | 8,000 | 700 | 746 |
| 12 | Sink | Gas | 48 | 45 | 47 |
| 13 | Network | Lift Gas | 45 | 33 | 35 |
| Obj. Value | | | | 2,439,838 | 2,442,610 |
| Sim. Calls | | | | 12 | 8 |

Oil, Water and Liquid rates (Stb), Gas-rates (Mmscfd), Obj. Value ($)

positions. Furthermore, W11 and W17 are set to intermediate positions. This leads to a better objective function value as indicated by Table 12. The number of constraints that are satisfied with equality is increased when dual control is introduced. And finally, the number of simulator calls is even reduced.

TABLE 13

Choke Positions for the Constrained 26-Well Case

| | Solution with Fixed Choke | Solution with Dual Control |
|---|---|---|
| W01 | 0 | 2 |
| W02 | 0 | 0 |
| W03 | 0 | 0 |
| W04 | 2 | 2 |
| W05 | 2 | 2 |
| W06 | 0 | 0 |
| W07 | 2 | 2 |
| W08 | 2 | 2 |
| W09 | 2 | 2 |
| W10 | 0 | 0 |
| W11 | 2 | 1.75 |
| W12 | 2 | 2 |
| W13 | 2 | 2 |
| W14 | 2 | 2 |
| W15 | 2 | 2 |
| W16 | 2 | 2 |
| W17 | 2 | 1.25 |
| W18 | 2 | 2 |
| W19 | 0 | 0 |
| W20 | 2 | 2 |
| W21 | 2 | 2 |
| W22 | 0 | 0 |
| W23 | 2 | 2 |
| W24 | 0 | 0 |
| W25 | 2 | 2 |
| W26 | 2 | 2 |

Choke size (inches)

7. Fractional Gas Separation

Up to this point, it can be assumed that the gas produced by the wells is sold. However, a production manager may decide to keep the gas for injection to the wells. This section addresses the issue of fractional gas separation and identifies the threshold below which it is optimal to preserve gas for improving production, but beyond that threshold, to sell the gas. This thresholding relies on the following hypothesis.

Hypothesis: When the gas is scarce (below some threshold), no gas is sold. Once the gas inventory reaches a certain threshold $\hat{C}$, it is optimal to store $\hat{C}$ units of gas for using lift-gas and sell anything beyond that. This type of policy may be called an "inventory preserving policy."

Let $\Pi_{online}(x, y; Q)$ denote the profit in the online problem 412, where vectors x, y, and Q denote the lift-gas injection 112, binary variables (well status and choke position), and the liquid rate from each well.

$$\Pi_{online}(x, y; Q) = \sum_{i=1}^{n} u_i Q_i - c_g \sum_{i=1}^{n} x_i \tag{44}$$

It is worth noting that $\Pi_{online}(x, y; Q)$ assumes that all the gas that is produced is sold and that all injected lift-gas 216 is preserved. Next, the following problem is defined:

$$F^*(C) = \max \Pi_{online}(x, y; Q) \tag{45}$$

$$\text{s.t.} \sum_{i=1}^{n} x_i = C \tag{46}$$

$$UQ + Vx \leq W \tag{47}$$

When $C=\hat{C}$, the profit is effectively $F^*(\hat{C})$, since all the lift-gas 216 is used and all that is produced is sold. By optimality, $F^*(\hat{C}) \geq F^*(C)$ for any $C \neq \hat{C}$. Thus, to obtain $\hat{C}$, it suffices to drop the capacity constraint and observe the value of the total lift-gas injected 216 in the above formulation.

$$F^*(\hat{C}) = \max \Pi_{online}(x, y; Q) \tag{48}$$

$$s.t.\ UQ + Vx \leq W \tag{49}$$

Table 12 presents two examples. The capacity constraint in the unconstrained 26-Well case is not binding. In one test, when dual control is not allowed, only 33 MMscf of gas are required. When dual control is allowed, only 35 MMscf of gas are required. Hence, it can be concluded that $\hat{C}=33$ in the constrained 26-Well case when dual control is not allowed and $\hat{C}=35$ when dual control is allowed.

8. Variations

In one implementation, the MINLP model 410 may be formulated with convex continuous relaxations, which can more readily be solved to global optimality. In the formulations that do not lead to convex continuous relaxations, BONMIN, or any other local optimizer, should be enhanced with some kind of stochastic algorithm, such as the simulated annealing that can be applied by the annealer 414. Formulations that do not lead to convex continuous relaxations are a major drawback when the number of binary variables is huge and the quality of the solution cannot be assessed. Therefore, formulations that give rise to convex continuous relaxations are recommended.

For the basic model, the following formulation is suggested. Let $q_i(x_i)$ be the smooth curve as defined earlier. Let $y_i$ be the binary variable that indicates if the well is active. All the wells are endowed with binary variables regardless of the well type. The basic model (see paragraph [0051] under section 3.1, above) is then reformulated as:

$$\max \sum_{i=1}^{n} [g_i(x_i) - g_i(0)(1 - y_i)] \tag{50}$$

$$\text{s.t} \sum_{i=1}^{n} x_i \le C \tag{51}$$

$$l_i y_i \le x_i \le u_i y_i \quad i = 1, 2, \ldots, n \tag{52}$$

$$y_i \in \{0, 1\} \quad i = 1, 2, \ldots, n \tag{53}$$

This formulation is equivalent to the original formulation and it has a convex continuous relaxation. This formulation has been tested with respect to the Buitrago reference and BONMIN was able to return the optimal solution with no starting point provided.

This approach is easily extendable to the piecewise defined curves. However, the number of variables is increased in return for a problem with a convex continuous relaxation. In the following formulation, an example is provided.

Assume for well i that there exists an integer $k_i \ge 1$, smooth functions $g_i^1(x_i)$, $g_i^2(x_i)$, . . . , $g_i^{ki}(x_i)$ and real numbers $0 = <l_0 < l_1 \ldots < l_{ki}$ such that $q_i(x_i) = g_i^k(x_i)$ for all $l_{k-1} \le x_i < l_k$, where $g_i^1(x_i)$ is well i's non-smooth production curve.

$$\max \sum_{i=1}^{n} q_i - c_g \sum_{i=1}^{n} x_i \tag{54}$$

$$\text{s.t } x_i = \sum_{k=1}^{k_i} x_i^k \tag{55}$$

$$q_i = \sum_{k=1}^{k_i} [g_i^k(x_i^k) - g_i^k(0)(1 - y_i^k)] \tag{56}$$

$$l_i^{k-1} y_i^k \le x_i^k \le l_i^k y_i^k \quad i = 1, 2, \ldots, n \tag{57}$$

$$\sum_{k=1}^{k_i} y_i^k \le 1 \quad i = 1, 2, \ldots, n \tag{58}$$

$$\sum_{i=1}^{n} x_i \le C \tag{59}$$

$$Uq + Vx \le W \tag{60}$$

$$y_i^k \in \{0, 1\} \text{ for all } i \text{ and } k \tag{61}$$

As a result, the lift-gas injected to well i equals $x_i = \Sigma_{k=1}^{k_i} x_i^k$ and the well status equals $y_i = \Sigma_{k=1}^{k_i} y_i^k$. It can be shown that this formulation is equivalent to the original formulation and has a convex continuous relaxation. However, the number of variables is greater. Testing convex formulations with increased problem size may actually be handled more efficiently by MINLP solvers 606. In this manner, a globally optimal solution is always guaranteed.

Lastly, the convex formulation for dual control problem is formulated. Due to the monotonicity of the production in the choke position, the gas injection 112 is always equal to zero if the choke 116 is not set to the maximum position. Let $h_i(c_i)$ denote the production of a well when the choke 116 is set to position $c_i$ and $x_i = 0$. Assuming that $h_i$ is well defined and concave, the following formulation is suggested. The maximum position well i can be set to is $\bar{c}_i$ and $c_i$ can take values from the set $C_i$, which can be continuous, discrete or a combination of both.

$$\max \sum_{i=1}^{n} q_i - c_g \sum_{i=1}^{n} x_i \tag{62}$$

$$\text{s.t } x_i = \sum_{k=1}^{k_i} x_i^k \tag{63}$$

$$q_i = \sum_{k=1}^{k_i} [g_i^k(x_i^k) - g_i^k(0)(1 - y_i^k)] + h_i(c_i) - h_i(0)(1 - y_i^c) \tag{64}$$

$$l_i^{k-1} y_i^k \le x_i^k \le l_i^k y_i^k \quad i = 1, 2, \ldots, n \tag{65}$$

$$\bar{c}_i(1 - y_i^c) \le c_i \le \bar{c}_i \quad i = 1, 2, \ldots, n \tag{66}$$

$$y_i^c + \sum_{k=1}^{k_i} y_i^k = 1 \quad i = 1, 2, \ldots, n \tag{67}$$

$$\sum_{i=1}^{n} x_i \le C \tag{68}$$

$$Uq + Vx \le W \tag{69}$$

$$y_i^k \in \{0, 1\} \text{ for all } i \text{ and } k \tag{70}$$

$$y_i^c \in \{0, 1\} \quad i = 1, 2, \ldots, n \tag{71}$$

$$c_i \in C_i \quad i = 1, 2, \ldots, n \tag{72}$$

Other variations include modeling several other production scenarios, such as wells with electrical submersible pump (ESPs). The methodology described above is general enough to be extended for various scenarios. Another alternative implementation would account for the transient behavior of the reservoir 102 and optimize the production network over time under varying operating conditions.

Example Methods

Figure 15:
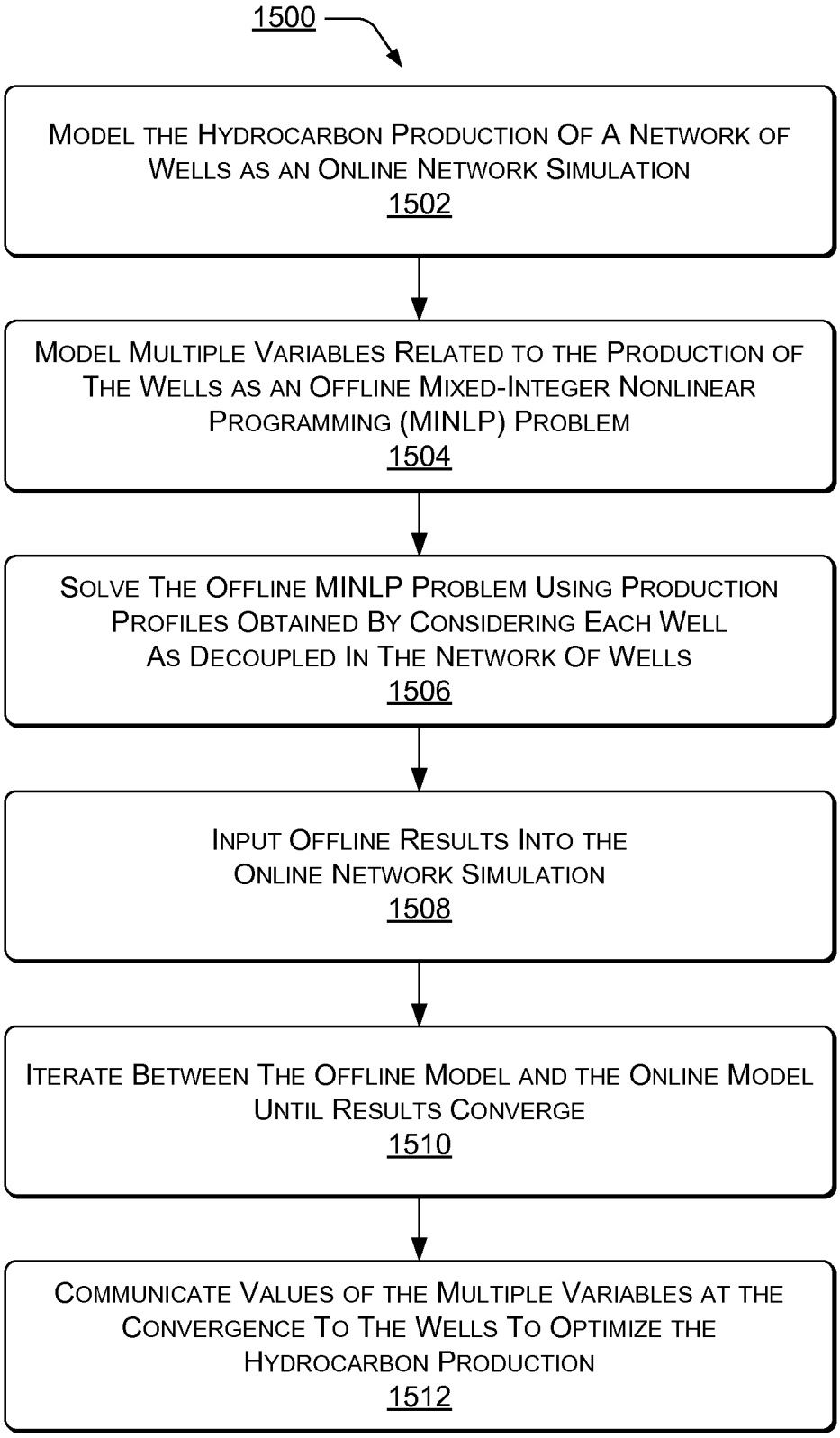
FIG. 15 is a flow diagram of an example method of optimizing production for an oilfield using a mixed-integer nonlinear programming model.

FIG. 15 shows an exemplary computer-executable method 1500 of optimizing production for an oilfield using a mixed-integer nonlinear programming model. In the flow diagram, the operations are summarized in individual blocks. The exemplary method 1500 may be performed by hardware, or combinations of hardware, software, firmware, etc., for example, by components of the exemplary production optimization system 100.

At block 1502, hydrocarbon production from a network of wells is modeled as an online network simulation. The networked wells are typically oil wells connected through a gathering network. A network simulator runs the network simulation online, calculating behavior over the entire network based on input parameters. The input parameters for a steady-state multiphase flow simulator may include a description of the gathering network, the well configurations, the pressures or flow rates at boundary conditions, the composition of the produced fluid in each well, the multiphase flow correlations employed, and the quantity of lift-gas injected into each well. The online model is not limited to these parameters. Each well may also have control devices, such as chokes or other valves. Almost any variable that affects the behavior of a well may be modeled by the network simulator.

At block 1504, multiple variables related to the production and lift performance curves of the wells are modeled as an offline mixed-integer nonlinear programming (MINLP) problem. For example, in one implementation the MINLP problem models the quantity of lift-gas to be allotted for injection into one or more wells, and also models one or more flow rate controls, such as the patency or open-closed state of one or more chokes or valves. Since such control variables may be a combination of integer, discrete, and continuous variables, there may be no conventional solution to the MINLP problem as a global model of the network.

At block 1506, the offline MINLP problem is solved, by utilizing the curve-based description of each well (i.e., the production profiles obtained at the preprocessing stage). The offline MINLP problem can be solved by considering the wells as decoupled in the actual network model in order to establish lift performance curves, but modeling the wells collectively to optimize hydrocarbon production: i.e., the optimized flow rate, lift-gas quantity when relevant, chokes settings, and so forth.

At block 1508, offline results are input into the online network simulation. That is, the offline results prime the online network simulator. The offline MINLP model has provided a highly optimized starting point for the network simulator to operate on. The computational load is drastically reduced, over having the network simulator exclusively model the network without a separable offline model.

At block 1510, the offline model and the online model are iterated between each other until their results converge. The process of priming the online network simulator with optimized offline values can be repeated by feeding the online results, such as a wellhead pressure value for each well in the network, back into the offline model and iterating between the offline model and the online model until the wellhead pressures converge. The computation load may be further reduced by streamlining. In one implementation, the operating constraints may be optionally scaled between the offline solver and the online simulator, so that mismatches can be adapted instead of giving rise to more computation needed to compensate for a mismatch in constraint values. Also, in one implementation, the wellhead pressures generated by the online network simulator for each well may be slightly different due to computational artifacts. The pressure differences can be smoothed over, for wells connected to the same manifold as these will have the pressure value in the real oilfield. This optional pressure value smoothing also streamlines the iteration process and reduces computational load.

At block 1512, the values of the multiple variables, at convergence, are communicated to the real-world wells to optimize hydrocarbon production. That is, when the offline-online iterative process has optimized the theoretical hydrocarbon production of the modeled network of wells, the control variables—e.g., quantities of lift-gas; subsurface choke settings, etc.—that are operative to cause the optimization are passed to the real-world control devices (computers, chokes, valves, etc.) to optimize the hydrocarbon production of the network in the real world.

CONCLUSION

Although exemplary systems have been described in language specific to structural features and/or methodological acts, it is to be understood that the subject matter defined in the appended claims is not necessarily limited to the specific features or acts described. Rather, the specific features and acts are disclosed as exemplary forms of implementing the claimed systems, methods, and structures.

The invention claimed is:

1. A computer-executable method, comprising:

modeling a network of interdependent wells for hydrocarbon production as a network simulation in an online model, wherein production of the wells is considered interdependent as between the wells in the online model;

modeling multiple interdependent variables related to the hydrocarbon production of the network and modeling lift performance curves of the interdependent wells as a mixed-integer nonlinear programming (MINLP) problem in an offline model, wherein production of the wells is considered independent as between the wells in the offline model;

solving the MINLP problem with a MINLP solver to obtain offline results, wherein solving the MINLP problem offline to obtain the offline results comprises solving the MINLP problem to obtain optimal values comprising an optimized allotment of lift-gas for the network of interdependent wells;

inputting the offline results comprising the optimized allotment of the lift-gas from the offline model into the network simulation of the online model to obtain online results including optimized wellhead pressures for the network of interdependent wells;

feeding-back the optimized wellhead pressures from the online model into the offline Model;

iterating between the offline model and the online model until the online and offline results reach convergence; and communicating the optimal values for the interdependent variables at the convergence from a controller to the network of interdependent wells to optimize hydrocarbon production.

2. The computer-executable method of claim 1, wherein:

the network of interdependent wells utilize both gas-lift injection and subsurface chokes;

modeling the multiple interdependent variables in the offline model comprises:

basing the offline model on production profiles established while assuming decoupled wells in the network of interdependent wells; and modeling an allotment of the lift-gas and modeling a choke setting as control variables in the offline mixed-integer nonlinear programming (MINLP) problem;

modeling the network of interdependent wells comprises creating the online model of the network of interdependent wells in a network simulator;

optimized allotment of the lift-gas for each gas-lift well is determined based on lift performance curves and an optimized choke setting, a wellhead pressure, and associated control variables at each individual well;

iterating between the offline model and the online model further comprises iterating solving the offline MINLP problem to obtain the optimized allotment of the lift-gas and inputting the optimized allotment into the online network simulator to obtain wellhead pressures, until values for the wellhead pressures reach the convergence; and communicating the optimal values for the interdependent variables at the convergence from the controller to the network of interdependent wells comprises signaling the optimal values of the control variables at the convergence to corresponding lift-gas injectors and subsurface chokes in the network of interdependent wells to maximize hydrocarbon production.

3. The method as recited in claim 2, wherein the control variables include a gas quantity for at least one gas-lift allotment and a choke control setting for at least one subsurface choke adjustment in the network of interdependent wells.

4. The method as recited in claim 2, wherein solving the MINLP problem to obtain the optimal values for the control variables is based on behavior of the lift-performance curves, utilization of performance as an objective function, operating constraints, well activation, and operating curve constraints.

5. The method as recited in claim 2, further comprising applying an annealing algorithm to generate starting points sequentially to decrease computational time by improving an initial objective function value for the offline model.

6. The method as recited in claim 2, further comprising smoothing wellhead pressure differences generated by the network simulator associated with wells connected to a same manifold to decrease computation time.

7. The method as recited in claim 2, further comprising reducing computation time by adapting constraints between the offline model and the online model when operating constraints are introduced, including adjusting offline constraints at each iteration to remove mismatches in the constraints due to using affine interpolation when no lift curve is available, inexact curve fitting, and network effects that affect the production of an individual well.

8. The method as recited in claim 2, further comprising deactivating a well in the offline model to meet operating constraints or to improve production from other wells, including ranking the wells at convergence based on a metric and deactivating the well with the lowest rank.

9. The method as recited in claim 1, wherein solving the MINLP problem includes simultaneously solving a discrete control variable for a subsurface choke and a continuous variable for a continuous gas-lift injection.

10. The method as recited in claim 1, wherein solving the MINLP problem includes simultaneously solving control variables for at least one subsurface choke, at least one gas-lift injection, and at least one of a well activation, a well deactivation, or a well-reactivation to optimize hydrocarbon production.

11. A system for simultaneously optimizing lift-gas allocation and choke settings to optimize hydrocarbon production in a network of interdependent wells, comprising:

a modeler to create an offline model of the network of interdependent wells in which variables controlling gas-lift injection and subsurface choke settings are modeled as a mixed-integer nonlinear programming (MINLP) problem, wherein the wells are considered independent in the offline model;

a network simulator to provide an online model of the network of interdependent wells, wherein the wells are considered interdependent in the online model;

a MINLP solver to obtain optimized allocation of the lift-gas for each well based on:

lift performance curves established while assuming decoupled wells in the network of interdependent wells;

a wellhead pressure; and associated control variables;

an iterator associated with the MINLP solver, for receiving output from the offline model as input for the network simulator and for receiving output from the network simulator as input for the offline model, the iterator performing functions that include:

receiving the optimized allocation of the lift-gas from the offline model for input into the online model of the network simulator to obtain optimized wellhead pressures for each well in the network of interdependent wells;

receiving the optimized wellhead pressures from the network simulator for input into the offline model; and iterating between the offline model and the online model, including iterating solving the MINLP problem in the offline model to obtain optimized allocations of the lift-gas and inputting the optimized allocations into the online model of the network simulator to obtain wellhead pressures, until values for the wellhead pressures converge; and a controller to send optimal values of the control variables to the network of interdependent wells to optimize hydrocarbon production.

12. The system of claim 11, wherein the control variables include a combination of:

an allocation of the lift-gas for at least one well;

a setting for at least one block valve; and a setting for at least one subsurface choke.

13. The system of claim 11, further comprising a preprocessor to compile lift performance curves for each well in the network of interdependent wells.

14. The system of claim 11, further comprising an annealer to generate starting points sequentially to decrease computational time by improving an initial objective function value for the offline model.

15. The system of claim 11, further comprising a smoother to decrease computation time by equalizing wellhead pressure profiles generated by the network simulator for wells connected to a given manifold.

16. The system of claim 11, further comprising a constraints scaler to reduce computation time by adjusting offline constraints at each iteration to remove mismatches in the constraints due to using affine interpolation when no lift curve is available, inexact curve fitting, and network effects that affect the production of an individual well.

17. The system of claim 11, further comprising a well deactivator to close a well in the offline model to meet operating constraints or to improve production from other wells, wherein the well deactivator ranks the wells based on a metric when the wellhead pressures converge and deactivates the well with the lowest rank.

18. A non-transitory computer-readable storage medium, containing instructions that, when executed by a computing system, cause the computing system to perform a method of decreasing a number of real function calls while computing revenue maximization at a sink of a network of interdependent wells for hydrocarbon production that utilize both gas-lift injection and subsurface chokes, the method comprising:

compiling a set of lift production curves for each lifted well in the network of interdependent wells, based on an assumption of decoupled wells in the network of interdependent wells;

modeling the hydrocarbon production of the network as a profit maximization in which variables that represent allotment of lift-gas and choke settings in the network are modeled as a mixed-integer nonlinear programming (MINLP) problem;

modeling the network in an online model in a network simulator, wherein the wells are considered interdependent in the online network simulator;

solving the MINLP problem using an offline model, wherein the wells are considered independent in the offline model, to obtain an optimized allotment of the lift-gas for each lifted well based on the lift production curves for the well, a wellhead pressure, and the corresponding variables that represent the allotment of the lift-gas and the choke settings at the well;

running the network simulator with the optimized allotment of the lift-gas from the offline model to obtain updated wellhead pressures for each well in the network of interdependent wells in the online model;

using the updated wellhead pressures to iterate between solving the MINLP problem of the offline model and running the network simulator to solve the online model until the wellhead pressures converge; and transmitting, to a controller of the network of interdependent wells, optimized control variables that occur at the convergence to control the allotment of the lift-gas and the choke settings in the network of interdependent wells to maximize revenue at the sink of the network of interdependent wells.

19. The computer-readable storage medium as recited in claim 18, further comprising instructions to include deactivation of a well in the MINLP problem to increase overall hydrocarbon production in the remaining wells, wherein the deactivation comprises applying a value for a choke setting variable that closes the well, the value obtained from solving the MINLP problem.

20. The computer-readable storage medium as recited in claim 18, further comprising instructions to adjust offline constraints at each iteration to attenuate differences between the offline model and the network simulator to reduce computation time.

* * * * *